US005886721A

United States Patent [19]

Fujii et al.

[11] Patent Number: 5,886,721

[45] Date of Patent: Mar. 23, 1999

[54] METHOD AND DEVICE FOR SUPPLYING INK TO A PRINT HEAD

[75] Inventors: Katsuyuki Fujii; Kazuyuki Oda; Junichi Yoshida; Katsuhide Ogawa; Ichiro Tomikawa; Jun Takagi; Yoshihiko Fujimura; Mituhide Soga, all of Ebina, Japan

[73] Assignee: Fuji Xerox Co., Ltd., Tokyo, Japan

[21] Appl. No.: 517,588

[22] Filed: Aug. 22, 1995

[30] Foreign Application Priority Data

| | | | |
|---|---|---|---|
| Aug. 23, 1984 | [JP] | Japan | 6-198574 |
| Dec. 8, 1994 | [JP] | Japan | 6-305069 |
| Feb. 28, 1995 | [JP] | Japan | 7-040937 |

[51] Int. Cl.[6] ..... B41J 2/175

[52] U.S. Cl. ..... 347/87

[58] Field of Search ..... 347/85, 86, 87

[56] References Cited

U.S. PATENT DOCUMENTS

| | | | |
|---|---|---|---|
| 4,571,599 | 2/1986 | Rezanka | 347/87 |
| 5,262,802 | 11/1993 | Karita et al. | 347/87 |
| 5,682,189 | 10/1997 | Takagi | 347/87 |

*Primary Examiner*—Shawn Riley

*Attorney, Agent, or Firm*—Finnegan, Henderson, Farabow, Garrett & Dunner, L.L.P.

[57] ABSTRACT

A main ink chamber with a through-hole contains a capillary member. An intermediate ink chamber is provided on the side wall of the main ink chamber. A path communicatively interconnects the main ink chamber and the intermediate ink chamber. A second meniscus forming member is disposed in a joint port, to thereby prevent ink leakage. In a print mode, ink flows from the main ink chamber to the joint port, through a meniscus forming member that is disposed in the through-hole. Air bubbles mingled into the ink move along the slanting upper wall of the path by their buoyant force, and are accumulatively stored in the upper part of the intermediate ink chamber. When ink is reduced to zero in the main ink chamber, air bubbles are introduced into the intermediate ink chamber through the meniscus forming member. As a result, the liquid level of the intermediate ink chamber is quickly reduced, thereby indicating a state that ink is used up.

27 Claims, 26 Drawing Sheets

METHOD AND DEVICE FOR SUPPLYING INK TO A PRINT HEAD

BACKGROUND OF THE INVENTION

The present invention relates to an ink supply device for supplying ink to a print head in an image recording device of the ink jet type, and an image recording device using the ink supply device.

An example of the conventional ink supply mechanism used in the ink jet image recording device is disclosed in Published Unexamined Japanese Patent Application No. Hei. 3-41351. In the construction of the ink supply mechanism, a porous material is disposed within an ink tank. One end of the ink tank is connected to the print head through a filter disposed therebetween. The other end of the ink tank includes an air hole formed therein. In the ink supply mechanism thus constructed, air is introduced into the filter through a minute gap between the porous material and the inner wall of the ink tank, and the supply of ink from the ink tank to the print head is frequently interrupted.

To solve the problem, Published Unexamined Japanese Patent Application No. Hei. 2-34354 was proposed. A rib is disposed on the inner wall of the ink tank in a state that the rib comes in contact with the ink absorbing member. The rib functions to block the flow of air bubbles into the print head. Also in the technique of the publication, when the contact of the rib with the sponge is poor, air moves along the inner wall of the ink tank to reach the print head.

Published Unexamined Japanese Patent Application No. Sho. 57-2786 proposes another solution for the air-mixing problem. In the proposed solution, an air trapping chamber containing a porous material therein is placed in the ink path which connects the print head to the ink container. However, this solution is imperfect in that the fluid resistance of the porous material per se is large, and when air bubbles stay over the entire surface of the porous material, the fluid resistance is increased. Where the fluid resistance is large, it is impossible to supply a sufficient amount of ink to the print head engaging itself in a high speed printing operation.

Published Unexamined Japanese Patent Application No. Sho. 59-95152 discloses another air trapping means in which a filter cloth for trapping air bubbles is stuck onto one side of an elastomer plate. When air bubbles stay on the entire surface of the filter cloth, the fluid resistance is increased and the same problem arises. That is, the ink supply mechanism of the publication can also supply an insufficient amount of ink to the print head when it operates for print at a high speed.

Published Unexamined Japanese Patent Application No. Hei. 3-189157 makes another technical proposal on this problem. A hollowed needle is provided at the joint where the ink tank is connected to the print head. A porous material is contained in the hollowed needle for trapping air bubbles, dust, etc. The construction of this ink supply mechanism requires a small inside diameter of the hollowed needle in order to obtain a good connection at the joint. Where the inside diameter of the hollowed needle is reduced, the area of the opening for the porous material is also reduced, while the fluid resistance is increased. As a result, the ink supply mechanisms also fails to sufficiently supply ink to the print head operating at a high speed.

A possible way to solve the problems of those proposals in which the porous material or the filter are used for trapping air bubbles is to enlarge the filter particles size of the porous material an the filter. This possible solution also involves a problem. That is, when a large amount of ink is consumed in a maintenance work, for example, air bubbles pass through the porous material or the filter to enter the print head, possibly causing print defect.

Published Unexamined Japanese Patent Application No. Sho. 60-262654 discloses another ink supply mechanism in which a subtank is located between the ink tank and the print head, and ink is temporarily stored in the subtank and then supplied to the print head. The subtank is opened to the air, air is separated from ink in the subtank, and only ink is supplied to the print head. In the construction of the ink supply mechanism, there is a possibility that ink leaks from the subtank through its opening. Further, in order to keep the ink pressure in a negative pressure, the print heat must be located above the subtank. Such a design restriction is laid upon a designer.

A means for detecting an amount of ink left in the ink supply mechanism of the type in which a capillary member, such as the porous material, is disposed in the ink chamber, is disclosed in Published Unexamined Japanese Patent Application No. Hei. 3-138158. A transparent tube, shaped like C, as a left-ink detector, is provided on the side of the housing containing the capillary member. When ink of the capillary member is consumed an the liquid level of the left ink goes below the C-shaped transparent tube, ink is moved from the C-shaped transparent tube to the capillary member. The amount of the left-ink is detected on the basis of the decrease of the ink level. Another technique for detecting the amount of the left-ink is disclosed in Published Unexamined Japanese Patent Application No. Hei. 5-42680. In the publication, at least a part of the side wall of an ink tank filled with porous material is made of transparent material. Grooves of different capillary forces are formed on the inside of the transparent part or window. Such a construction that the left-ink detecting window is within the ink chamber filled with the porous material, is sensitive to a variation of the capillary forces of the porous material. Further, the grooves, which form the visually detecting part, are narrow. This makes it hard to detect the amount of left-ink. Further, in the construction, air inevitably enters the grooves when ink is filled into the ink tank. This requires additional work to remove ink from the grooves.

SUMMARY OF THE INVENTION

Accordingly, an object of the present invention is to provide an ink supply device which is capable of blocking the entering of air bubbles into the print head in the process of supplying ink from the ink chamber to the print head, without increasing the fluid resistance. Another object of the present invention is to provide an ink supply device which is capable of detecting the amount of left-ink while having the above function.

The present invention succeeds in achieving the above objects by the inventive and creative constructions as will be described hereinafter.

A first aspect of the present invention sets forth an ink supply device for supplying ink to a print head comprising: a main ink chamber including an air hole and a through-hole for supplying ink; a capillary member contained in the main ink chamber; a meniscus forming member with a number of minute holes disposed in the through-hole and in contact with the capillary member; an intermediate ink chamber as a hermetically closed, small chamber; and a path communicating with the through-hole of the main ink chamber, the intermediate ink chamber, and the print head, the upper wall of the path being slanted ascending from the connection part between the path and the through-hole toward the intermediate ink chamber, whereby the slanting wall smoothly guides the air bubbles coming in through the meniscus forming member, to the intermediate ink chamber through the through-hole.

A second aspect of the present invention sets forth an ink supply device for supplying ink to a print head comprising: a main ink chamber including an air hole and a through-hole for supplying ink; a capillary member contained in the main ink chamber; a first meniscus forming member with a number of minute holes disposed in the through-hole and in contact with the capillary member; an intermediate ink chamber as a hermetically closed, small chamber; a path communicating with the through-hole of the main ink chamber and the intermediate ink chamber, the path having a joint port for supplying ink to the print head, and the upper wall of the path being slanted ascending from the connection part between the path and the through-hole toward the intermediate ink chamber; and a second meniscus forming member with a number of minute holes disposed in the joint port, whereby the slanting wall smoothly guides the air bubbles coming in through the first meniscus forming member, to the intermediate ink chamber through the through-hole, and the ink supply device is connected at the joint port to the print head.

A third aspect of the present invention sets forth an ink supply device for supplying ink to a print head having at least a main ink chamber including an air hole and a through-hole for supplying ink, a capillary member contained in the main ink chamber, a meniscus forming member with a number of minute holes disposed in the through-hole and in contact with the capillary member, and an intermediate ink chamber as a hermetically closed, small chamber, wherein the bottom surface of the main ink chamber is slanted ascending from the through-hole toward the circumferential outer side thereof, the slanting bottom surface of the capillary member is more slanted than the slanting bottom surface of the main ink chamber, and the capillary member is inserted into the main ink chamber such that the slanting bottom surface of the capillary member is entirely brought into contact with the slanting bottom surface of the main ink chamber.

A forth aspect of the present invention sets forth an ink supply device for supplying ink to a print head comprising: a main ink chamber including an air hole and a through-hole for supplying ink; a capillary member contained in the main ink chamber; a first meniscus forming member with a number of minute holes disposed in the through-hole in contact with the capillary member; an intermediate ink chamber as a hermetically closed, small chamber; a path communicating with the through-hole of the main ink chamber and the intermediate ink chamber and having a joint port for supplying ink to the print head; a second meniscus forming member with a number of minute holes disposed in the joint port; and means for preventing the finger from closing the air hole, the means disposed near the air hole.

A fifth aspect of the present invention sets forth a method of supplying ink from an ink supply device to a print head with which the ink supply device is removably coupled, the ink supply device including a main ink chamber including an air hole and a through-hole for supplying ink, a capillary member contained in the main ink chamber, a first meniscus forming member with a number of minute holes disposed in the through-hole and in contact with the capillary member, a path communicating with the main ink chamber and the intermediate ink chamber and having a joint port for supplying ink to the print head, a second meniscus forming member with a number of minute holes disposed in the joint port, and an intermediate ink chamber as a hermetically closed, small chamber communicating with the path, the print head including nozzles for forcibly spouting ink droplets, and an ink guide means that may be water-tightly coupled with the joint port of the ink supply device, wherein the joint port of the ink supply device is coupled with the ink guide means of the print head in a state that the air hole of the main ink chamber is left open, a pressure generated when the joint port is coupled with the ink guide means causes air staying between the joint port and the ink guide means to flow into the path through the second meniscus forming member, and with increase of a negative pressure in the print head, ink is supplied from the ink supply device to the print head through the joint port. In the invention of the first aspect, when the ink supply device is attached to the image recording device, the capillary member holds ink, and keeps a negative pressure in the print head. When ink is consumed by the print head, the ink moves from the capillary member to the print head by a route of the meniscus forming member, the through-hole, and the path. Air bubbles, which enters the main ink chamber, is trapped by the meniscus forming member.

When the ink supply device is clogged with ink and dust, these are usually sucked from the nozzles. A negative pressure generated by the suction is higher than a negative pressure generated in the normal ink supply. By the large negative pressure, air bubbles above the capillary member, together with ink, rarely pass through the meniscus forming member. The air bubbles contained in the ink move, by their buoyant force, along the slanting upper wall of the path to the intermediate ink chamber, and are accumulatively stored in the upper part of the intermediate ink chamber. Thus, air is separated from the ink, and only ink is supplied to the print head. The image recording can be continued with a high picture quality.

When the consumption of ink progresses and ink is reduced to zero in the main ink chamber, the negative pressure is held by the meniscus of ink formed by the meniscus forming member. With increase of the negative pressure, the ink meniscus is pushed and air passes therethrough in the form of air bubbles. The negative pressure is decreased by the quantity of pressure corresponding to the volume of the air bubbles. In this way, the negative pressure is kept substantially constant. The air bubbles, which have pass through the meniscus forming member, move, by their buoyant force, along the slanting upper wall of the path to the intermediate ink chamber, and are accumulatively stored in the upper part of the intermediate ink chamber. The air bubbles never go to the print head.

Thus, the air bubbles are trapped by the meniscus forming member. The air bubbles that have passed through the meniscus forming member are accumulated in the intermediate ink chamber. Accordingly, the fluid resistance is much smaller than that required for completely preventing the penetration of air bubbles as in the conventional case. Accordingly, it is possible to prevent air bubbles from entering the print head without increasing the fluid resistance.

The invention of the second aspect additionally uses the second meniscus forming member. With the use of the second meniscus forming member, no ink is leaked from the joint port when the ink supply device is left alone. The negative pressure for ink is kept by the capillary force of the capillary member in the main ink chamber. The entering of air into the ink supply device is blocked by the surface tension of the surface of ink formed in the second meniscus forming member. No ink is leaked out of the ink supply device. When the ink supply device is coupled at the joint port with the print head, air present at the joint port is caused to move to through the second meniscus forming member to the path by the pressure generated when the ink supply device is coupled with the print head, thereby minimizing the air to be mingled into the ink when the ink supply device is coupled with the print head. Air bubbles that have entered the path move, by their buoyant force, along the slanting upper wall of the path to the intermediate ink chamber, and are accumulatively stored in the intermediate ink chamber. During the printing operation and the suction operation, the first meniscus forming member, or the meniscus forming member of the first aspect operates to block the flow of air bubbles into the print head. Since the ink supply device of the second aspect is separated from the print head, reduction of the running cost is realized.

In the ink supply device of the third aspect, the bottom surface of the main ink chamber is slanted ascending from the through-hole toward the circumferential outer side thereof, and the slanting bottom surface of the capillary member is more slanted than the slanting bottom surface of the main ink chamber. When the capillary member is inserted into the main ink chamber, the slanting bottom surface of the capillary member is entirely brought into contact with the slanting bottom surface of the main ink chamber. With such a structure, a portion of the bottom end of the capillary member near the through-hole is more compressed than a portion thereof apart from the through-hole, causing a density gradient. When ink is consumed by the print head, ink starts to move at the terminal of the capillary member where is low in density and weak in ink holding force, so that an efficient ink supply is ensured with little residual ink.

The ink supply device of the forth aspect is separable from the print head. In the ink supply device, means for preventing the finger from closing the air hole is disposed near the air hole. If the air hole is closed in a state that the ink supply device is removed from the print head, the pressure system in the ink supply device loses its balance. Sometimes ink is leaked out of the ink supply device. With provision of the means for preventing the finger from closing the air hole, the air hole will never be closed when the ink supply device is handled, and no ink leakage takes place.

The fifth aspect sets forth a method of supplying ink from an ink supply device to a print head with which the ink supply device is removably coupled. In the ink supply method, the joint port of the ink supply device is coupled with the ink guide means of the print head in a state that the air hole of the main ink chamber is left open. A pressure generated when the joint port is coupled with the ink guide means causes air staying between the joint port and the ink guide means to flow into the path through the second meniscus forming member. As a result, the air that will enter the print head and the amount of ink sucked in a maintenance work, for example are minimized. In the maintenance or the normal consumption of ink, ink is supplied from the ink supply device to the print head through the joint port.

BRIEF DESCRIPTION OF THE DRAWINGS

FIG. 6(A) is a view schematically showing the capillary member, and FIG. 6(B) is a view schematically showing the main ink chamber.

DETAILED DESCRIPTION OF THE PREFERRED EMBODIMENTS

Figure 1:
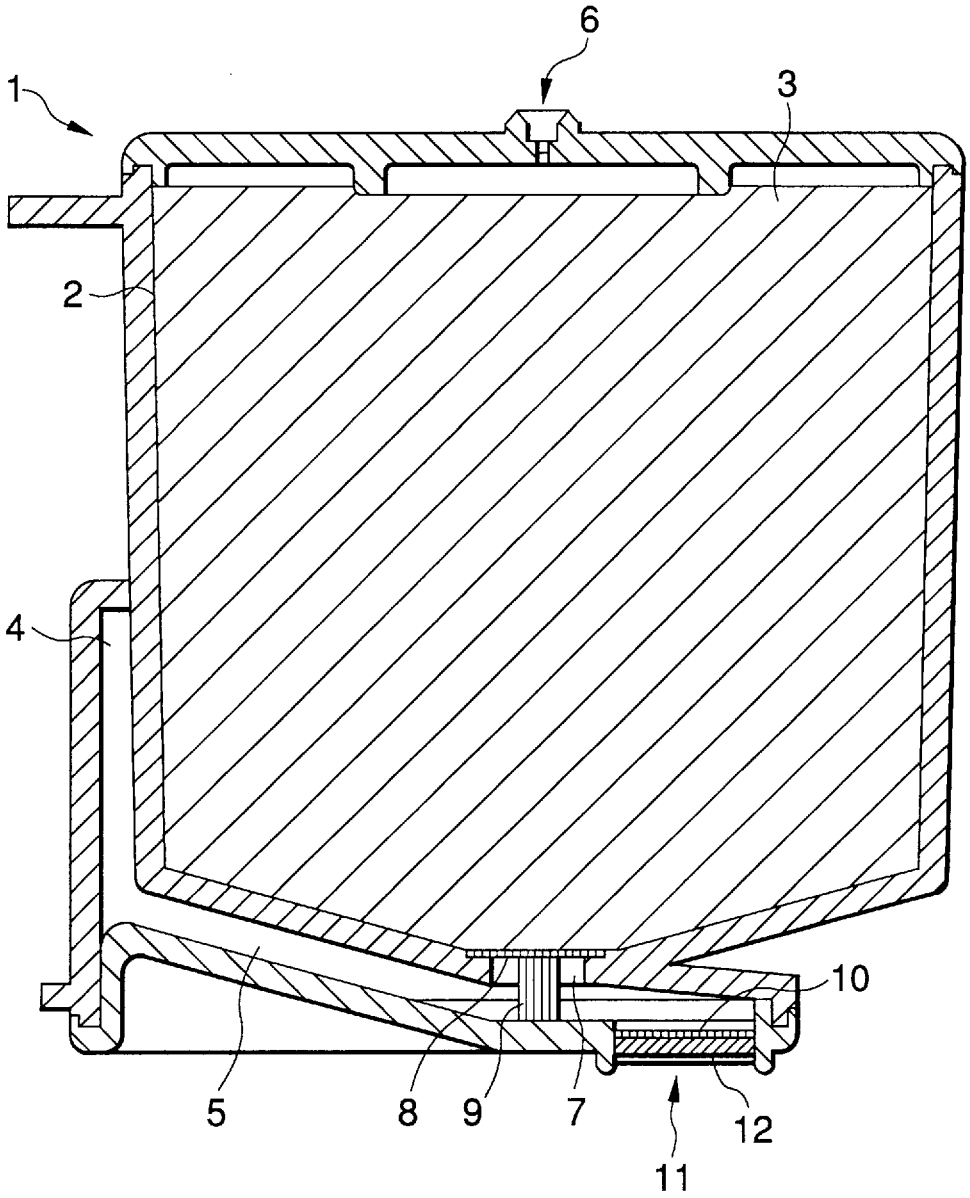
FIG. 1 is a cross sectional view showing a first embodiment of an ink supply device according to the present invention.
Figure 2:
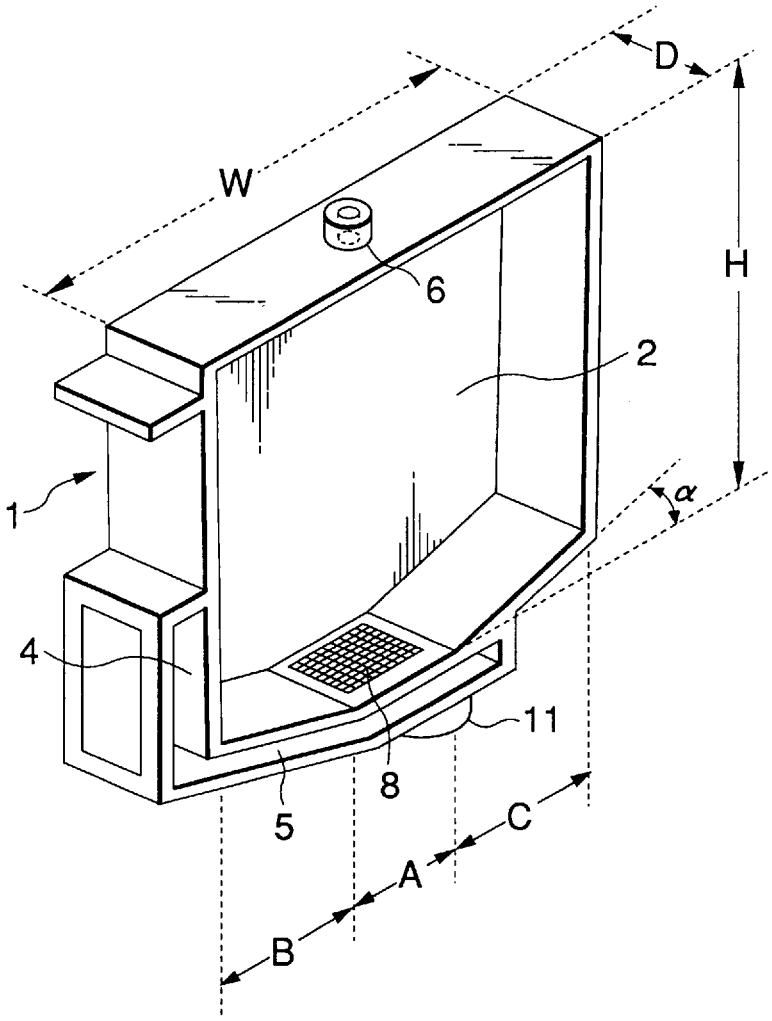
FIG. 2 is a perspective view showing the ink supply device of FIG. 1.
Figure 3:
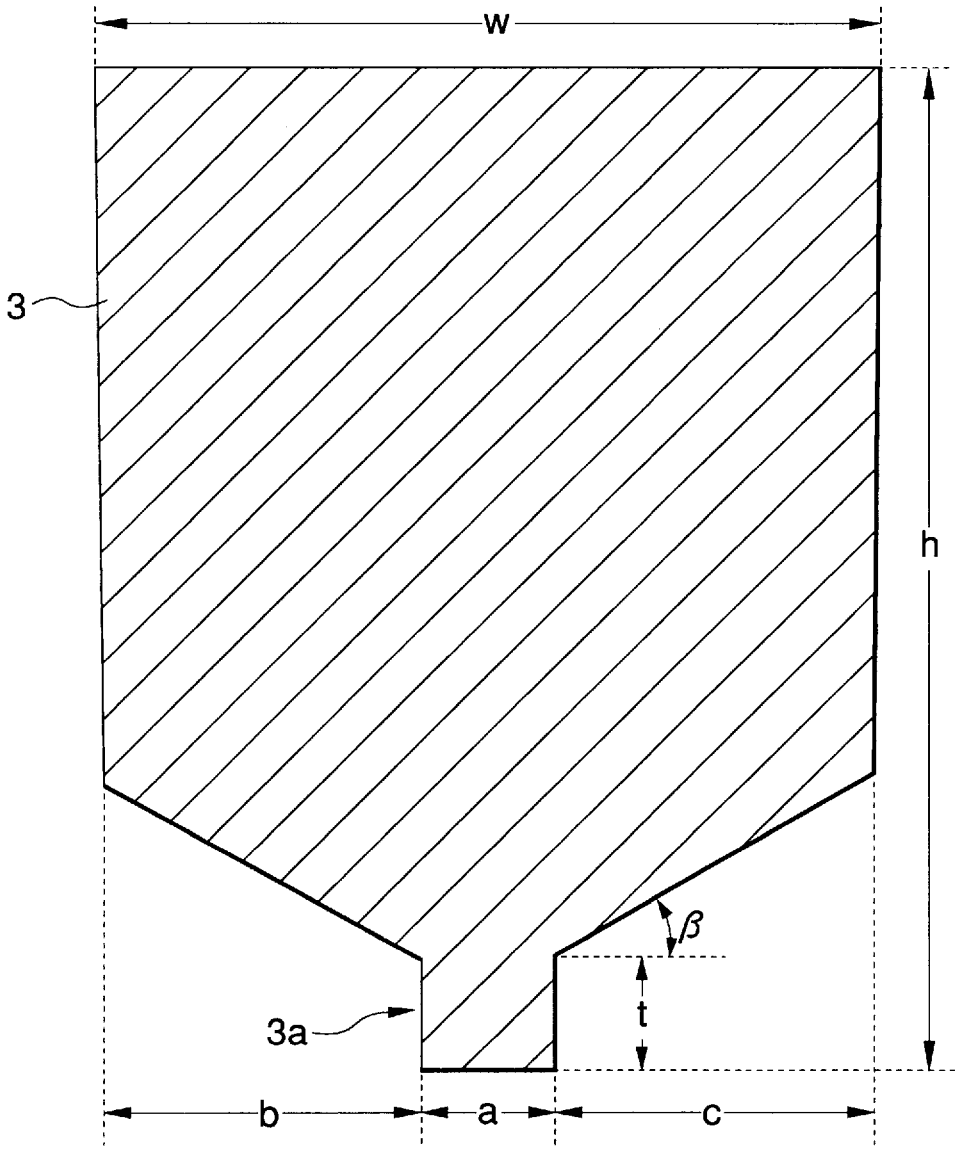
FIG. 3 is a cross sectional view showing a configuration of a capillary member.

FIG. 1 is a cross sectional view showing a first embodiment of an ink supply device according to the present invention. FIG. 2 is a perspective view showing the ink supply device of FIG. 1. FIG. 3 is a cross sectional view showing a configuration of a capillary member. In the figures, reference numeral 1 designates an ink tank; 2, a main ink chamber; 3, a capillary member; 4, an intermediate ink chamber; 5, a path; 6, an air hole; 7, a through-hole; 8, a first meniscus forming member; 9, an ink supply portion; 10, a second meniscus forming member; 11, joint port; and 12, an absorbing member. The ink supply device of the present embodiment is used separately from a print head. In the illustration of FIG. 2, the side wall located on this side and the capillary member 3 are omitted.

As shown, the ink tank 1 includes the main ink chamber 2 and the intermediate ink chamber 4 located on the side of the main ink chamber 2. To secure a satisfactory rigidity and a long time ink holding, a material of good ink-proof is selected for the material of the ink tank 1. The ink tank 1 is connected at the joint port 11 to a print head, not shown. Ink is supplied from the main ink chamber 2 to the print head, through the path 5 and the joint port 11.

The through-hole 7 is formed in the bottom of the main ink chamber 2. The main ink chamber 2 communicates with the intermediate ink chamber 4 and the joint port 11, through the through-hole 7 and the path 5. The cross section of the through-hole 7 may take any of various forms, such as a circle, ellipse, polygon, star-like form, cross-like form, and a slit-like form. The bottom surface of the main ink chamber 2 is inclined toward the through-hole 7. The slanting surface, or the bottom surface of the main ink chamber 2, as shown in FIG. 2, in inclined at angle $\alpha°$ with respect to the horizontal surface on which the first meniscus forming member 8 is located.

The capillary member 3 is disposed in the main ink chamber 2. The capillary member 3 holds ink by tis capillary action, and maintains a negative pressure of a print head. The capillary member 3 may be made of any of fiber material of the two dimensional structure, porous material of the three-dimensional structure, and felt or nonwoven material formed by spinning fibers in a three dimensional fashion. A specific example of the material for the capillary member 3 is medium cotton formed by bundling polyester fibers unidirectionally. The medium cotton has preferably a density (=weight/volume) within the rang of 5% to 15%. Polyester felt that is formed by spinning polyester fibers in a three-dimensional fashion may be used for it. A preferable density of the polyester felt is within the range from 0.05 g/cm$^3$ to 0.1 g/cm$^3$. These density values are preferable in the light of fluid resistance and capillary force in connection with ink. The material for the capillary member 3 is not limited to the polyester fibers, as a matter of course. Any other material may be used for the capillary member 3, if it has a proper capillary force and an ink-resistance nature. In the present embodiment, polyester felt of 0.05 g/cm$^3$ in density (when the main ink chamber is filled with ink) is used.

The configuration of the capillary member 3 is shown in FIG. 3. Numeral 3*a* indicates a protruded portion. The configuration of the capillary member 3 resembles the inner configuration of the main ink chamber 2, but the former is somewhat larger than the latter. The capillary member 3 is inserted into the main ink chamber 2.

The bottom of the capillary member is defined by an slanting surface that is inclined at angle $\beta°$ with respect to the plane parallel to the upper surface of the capillary member 3. The portion 3*a* to be in contact with the through-hole defined by the first meniscus forming member 8 (FIGS. 1 and 2) is protruded. The height of the protruded portion 3*a* is $\underline{t}$ mm.

The angle $\alpha°$ (FIG. 2) and the angle $\beta°$ (FIG. 3) are: $\beta>\alpha$, preferably $\beta-\alpha=15°$. The height $\underline{t}$ of the protruded portion 3*a* is preferably 4 mm, t=4 mm. The capillary member thus configured is inserted into the main ink chamber 2 (FIGS. 1 and 2) till the bottom of the capillary member is brought into contact with the entire bottom surface of the main ink chamber 2. At this time, the protruded portion 3*a* is pressed against the upper surface of the first meniscus forming member 8, to thereby be deformed. As a result, an extremely high density is created in the capillary member. Also in a region of the capillary member around the through-hole 7, a region near to the through-hole 7 is particularly high in density because of presence of the slant. With the density gradient, ink starts to move from the terminal portion of the capillary member where is low in density and weak in ink holding force, when ink is consumed by the print head. Accordingly, an efficient supply of ink is realized with the least of the final residual ink.

Returning to FIGS. 1 and 2, the air hole 6 is formed in the upper side of the main ink chamber 2. Through the air hole 6, the capillary member 3 connects to the air. In the present invention, the diameter of the air hole 6 is larger than the diameter of the hole of the capillary member 3 or the width of each gap among the fibers. The capillary member 3 connects at the top to the air or is opened to the air. When the print head is in an ink supply mode, an atmospheric pressure pushes the ink down in the capillary member 3 in the upper side of the capillary member, while at the same time a negative pressure of the print head pulls the ink down to the path 5 in the lower side of the capillary member. Accordingly, the ink in the capillary member 3 can be used efficiently. At this time, the negative pressure of the print head is kept constant by a capillary force of the capillary member 3. A sheet which allows air to pass therethrough but prohibits ink to pass therethrough, may be provided in the air hole 6. Alternatively, a number of minute holes having the same function as of the sheet may be arrayed in the air hole 6.

The first meniscus forming member 8 is disposed in the through-hole 7 of the bottom of the main ink chamber 2. The bottom of the capillary member 3 is pressed against the first meniscus forming member 8. The first meniscus forming member 8 may be formed of a mesh-like material, such as wire or resin net, or a porous material. Examples of the mesh-like member are a metal mesh filter, a filter formed using a base that is formed by working metal fibers, for example, fine wires of SUS into a felt-like material, and compressing the sintering the resultant, and an electrofoaming metal filter. The first meniscus forming member 8 may also be a filter of resin fibers, such as tatami fabric, or metal knitting, or a filter with extremely fine holes, worked by the laser beam or electron beam. The first meniscus forming member 8 may take any suitable form, such as a circular form, rectangular form, or any other form, if it covers the through-hole 7.

When the capillary member 3 contains ink, the ink moves to the intermediate ink chamber 4 through the first meniscus forming member 8. Also in a case where ink of the capillary member 3 is used up, the first meniscus forming member 8 prevents superfluous air from entering the intermediate ink chamber 4. When the ink is further consumed, air coming in through the air hole 6 passes through the capillary member 3, presses the meniscus in the fine holes of the first meniscus forming member 8 that contacts with the capillary member 3 (since the negative pressure in the main ink chamber 2 increases), surpasses the surface tension thereof to pass through the fine holes, and finally becomes air bubbles. The air bubbles generated move through the path 5 to the intermediate ink chamber 4. A pressure (bubble point pressure), which causes air bubbles, depends on a filter particle size of the first meniscus forming member 8. An optimal filter particle size keeps the negative pressure in the ink tank 1, vis., a pressure to supply ink to the print head, at a constant value. A preferable filter particle size of the first meniscus forming member 8 ranges from approximately 40 $\mu$m to 70 $\mu$m, for example.

The first meniscus forming member 8 may be extended up to the bottom of the path 5 in the form of the ink supply portion 9. The ink supply portion 9 is smaller in diameter than the through-hole 7. A case where air bubbles stay under the first meniscus forming member 8 and an air layer is formed there, or where ink is used up in the main ink chamber 2 and the ink level goes below the height of the through-hole 7, exists. In this case, the ink supply portion 9 sucks up ink left on the bottom of the path 5 and supplies it to the first meniscus forming member 8. As a result, the first meniscus forming member 8 is kept wet, so that the negative pressure is maintained. With provision of the ink supply portion 9, the best condition of the device is maintained till the ink is used up. The ink supply portion 9 may be properly shaped like a slit, rectangular parallelepiped, triangular pyramid, cylinder, an elliptical cylinder, or the like. Two or more number of extended portions may be used, as a matter of course.

The ink supply portion 9 may be an individual member, not the extended portion of the first meniscus forming member 8. In this case, it is directly attached to the first meniscus forming member 8 so as to come in contact with the first meniscus forming member 8, or supported by a rib from the side wall of the through-hole 7. The material of the ink supply portion 9 as the individual member may be different from that of the first meniscus forming member 8, if it is able to suck up ink to the first meniscus forming member 8 by capillary force. Examples of the material are medium cotton formed by bundling polyester fibers unidirectionally, porous material of polyurethane, melamine foam, or the like, and two- or three-dimensional fiber structure.

The path 5 is communicatively connected to the intermediate ink chamber 4, the main ink chamber 2, and the joint port 11 in this order. The upper wall of the path 5 may be horizontal or slanted ascending toward the intermediate ink chamber 4 (FIG. 1). The slanting wall is capable of smoothly guiding the air bubbles generated in the through-hole 7 to the intermediate ink chamber 4. The slant may be provided over only a segment between the intermediate ink chamber 4 and the main ink chamber 2. The slant further extended over a segment between the main ink chamber 2 and the joint port 11 causes the air bubbles led from the joint port 11 to smoothly move to the intermediate ink chamber 4. The lower wall of the path 5 may be horizontal. In the present embodiment, it is slanted over only the segment between the intermediate ink chamber 4 and the main ink chamber 2, in order to reduce the amount of residual ink as small as possible.

In the initial stage, the intermediate ink chamber 4 is filled with ink. Air bubbles that have come from the main ink chamber 2 through the first meniscus forming member 8 and reached the path 5, are accumulatively stored in the intermediate ink chamber 4. The size of the intermediate ink chamber 4 is selected as to be large enough to store the air bubbles rarely reaching there till ink is reduced to zero in the main ink chamber 2. Accordingly, it may be small in size. To gather the air bubbles, the upper surface of the intermediate ink chamber 4 must be selected to be higher than the through-hole 7 of the main ink chamber 2.

The second meniscus forming member 10 and the absorbing member 12 are provided in this order in the joint port 11. In a state that the ink tank 1 is removed from the print head and left alone, the surface tension of ink in the fine holes of the second meniscus forming member 10 prevents ink from being leaked outside from the intermediate ink chamber 4 and the path 5 through the joint port 11. When the ink tank 1 is attached to an image recording device (referred simply to a printer), air is left in the joint port 11 by the pressure generated at that time. The air passes through ink films of the second meniscus forming member 10 and reaches the intermediate ink chamber 4. Reduction of entering air bubbles into the print head is realized. Further, when the ink tank 1 is attached, it blocks the transmission of vibration, impact, pressure variation by acceleration to the ink tank 1 and the entering of air bubbles from the nozzle of the print head into the ink tank. Examples of the second meniscus forming member 10 are an SUS mesh or a filter formed using abase that is formed by working fine wires of SUS into a felt-like material, and compressing and sintering the resultant. In this case, the diameter of the meniscus opening must be 10 $\mu$m to 50 $\mu$m. The meniscus opening diameter is determined depending on the capillary member 3 and ink characteristic, the dimension of the ink tank 1, and the like. It is selected in design to that no ink is leaked when the ink tank 1 is removed and no air enters into the ink tank 1 when it is turned upside down.

The absorbing member 12 disposed in the joint port 11 is used for preventing ink from dropping from the joint port when the ink tank 1 is attached to and removed from the print head. The absorbing member 12 is made of a material of good ink absorbing ability, such as a sponge, medium cotton formed by bundling polyester fibers unidirectionally, or polyester felt. It is desirable that the fluid resistance of the absorbing member 12 is low.

Figure 4:
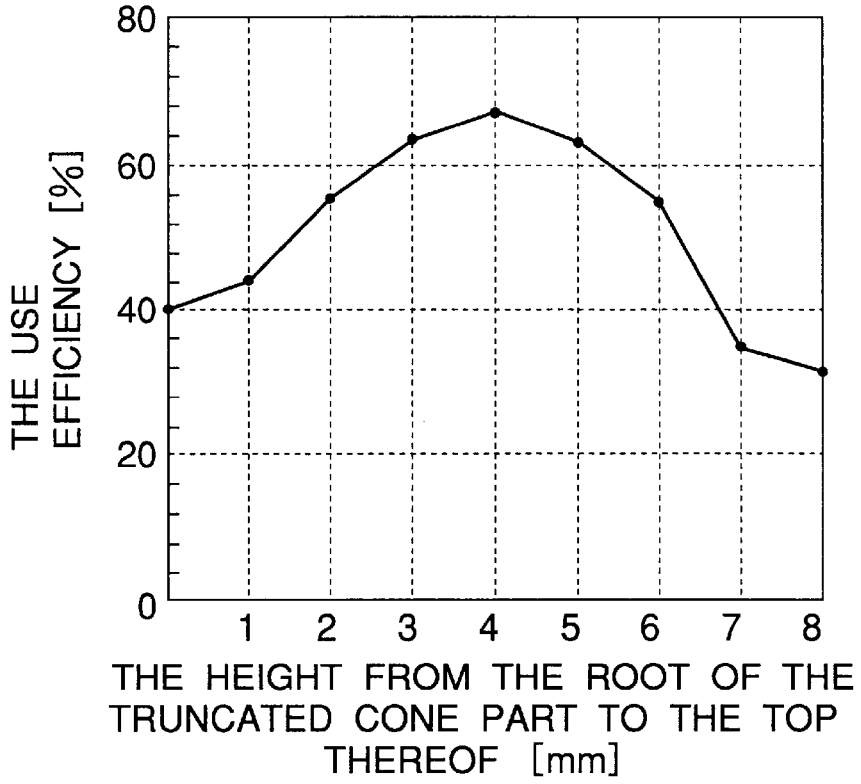
FIG. 4 is a graph showing a variation of ink use efficiency with respect to the height of the protruded portion.

The configuration of the capillary member referred to in connection with FIG. 3 will be described. FIG. 4 is a graph showing a variation of ink use efficiency with respect to the height of the protruded portion. Data plotted in the graph were gathered under the condition that angle α (of the slanting lower surface of the main ink chamber)=15°, angle β (of the slanting bottom surface of the capillary member) =30°, and the height t of the protruded portion=0 mm to 8 mm. The term "ink use efficiency" is defined as: "total volume of ink that can be used by the print head/total content of the ink tank", and the unit of it is %.

The graph of FIG. 4 teaches the following facts. To construct an ink tank of which the ink use efficiency is high, vis., a high efficiency ink tank, the height t of the protruded portion is preferably 2 mm to 6 mm. Within this range, the ink use efficiency is high, 50% or more. More preferably, t=4 mm. When t=4 mm, the ink use efficiency=70%. Under this condition, it is possible to provide a high efficiency ink supply mechanism with an extremely small residual ink.

Figure 5:
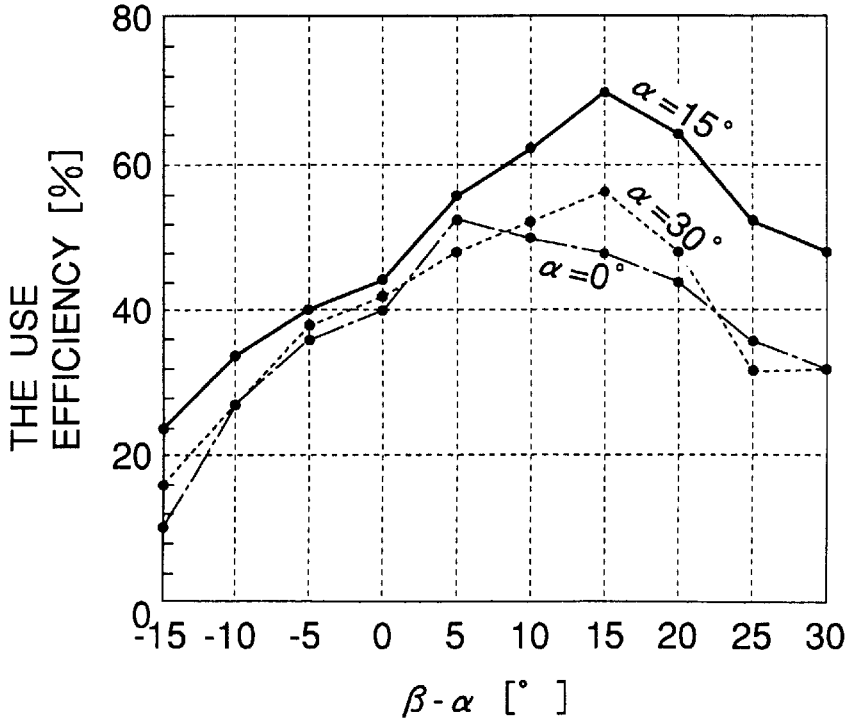
FIG. 5 is a graph showing a correlation among the angle $\alpha$ of the slanting lower surface of the main ink chamber, the angle $\beta$ of the slanting bottom surface of the capillary member, and the ink use efficiency.

FIG. 5 is a graph showing a correlation among the angle α of the slanting lower surface of the main ink chamber, the angle β of the slanting bottom surface of the capillary member, and the ink use efficiency. Specifically, a variation of the ink use efficiency with respect to β−α is plotted when α=0°, α=15°, and α=30°. In this case, t=4 mm (t: height of the protruded portion).

As seen from the graph, of those angle values, 15° (=α) provides the highest ink use efficiency. The ink use efficiency is high when β−α is within the range from 5° to 20°. From these facts, it is seen that the best angle of the slanting lower surface of the main ink chamber is 15°. The highest ink use efficiency, approximately 70%, is gained when β−α=15°.

Let us consider the empirical description in FIGS. 4 and 5. As seen from FIG. 4, the high ink use efficiency of 50% or higher is realized when t=2 mm to 6 mm. When the capillary member is inserted into the main ink chamber, the protruded portion is pressed against the first meniscus forming member to be deformed. A particularly high density is created in a region of the capillary member near the first meniscus forming member. Ink starts to move from the terminal portion of the capillary member where is low in density and weak in ink holding force, when ink is consumed by the print head. Accordingly, an efficient supply of ink is realized with the least of the final residue ink.

The capillary member above the through-hole is particularly high in density. Because of this, it is possible to block air coming through a gap between the walls of the main ink chamber and the capillary member. Accordingly, an efficient supply of ink is realized with the least of the final residual ink.

Where t>7 mm, the ink use efficiency is abruptly reduced. The reason for this can be considered as follows. The protruded portion is excessively large. When the capillary member is put into the main ink chamber, some part of the protruded portion remains not deformed because its excessive size. The result is formation of gaps and cavities which provide paths of air. In a state that much ink is left in the capillary member, air enters the intermediate ink chamber through the first meniscus forming member. As a result, the ink use efficiency of the ink tank is remarkably reduced.

As seen from FIG. 5, the ink use efficiency is high when α=15°. Where α=0°, ink is left at the four corners of the bottom of the main ink chamber that are apart from the through-hole having the first meniscus forming member located thereon and connects to the intermediate ink chamber. Then, the ink use efficiency is low. On the other hand, where α≠0°, viz., the bottom surface of the main ink chamber is slanted, the four corners of the bottom surface of the main ink chamber is higher than the first meniscus forming member. Under the pressure head of ink, ink easily moves to the first meniscus forming member. The residual ink is reduced, and the ink use efficiency is improved. However, where α=30°, the ink use efficiency is low. In this case, the angle of the bottom surface is too large, the volume for the bottom surface is remarkably reduced, so that the capacity of the ink tank is reduced. The only way to realize the ink tank of the same capacity is to increase the height of the ink tank if the thickness of the ink tank is fixed. If the height of the ink tank is increased, the pressure head of ink is increased. In this state, to cause a negative pressure in the print head, it is necessary to reduce the amount of ink injected in the initial stage. If so done, the result is reduction of the ink use efficiency. Thus, where the angle of the slanting surface is large, it is impossible to increase the ink use efficiency. As a consequence, α≈15° is preferable.

The ink use efficiency is high when β−α=5° to 20°. The reason for this can be considered as follows. The angle β of the slanting bottom surface of the capillary member is somewhat larger than the angle α of the slanting bottom surface of the main ink chamber. When the capillary member is inserted into the main ink chamber, the slanting bottom surface of the capillary member is pressed against the slanting bottom surface of the main ink chamber, so that it is deformed. At this time, a region of the capillary member near the through-hole that has the first meniscus forming member located thereon and connects to the intermediate ink chamber is particularly high in density, because β>α. Thus, a density gradient is created in the capillary member. With the density gradient, ink starts to move from the terminal portion of the capillary member where is low in density and weak in ink holding force, when ink is consumed by the print head. Accordingly, an efficient supply of ink is realized with the least of the final residual ink.

On the basis of the above-mentioned technical facts, the ink tank of FIG. 2 was designed to have the following inside dimensions (FIG. 2):

A=8.4 mm; B=19.4 mm; C=19.4 mm; H=49 mm; W=49 mm; and D=9 mm, where A: length of the horizontal portion of the bottom surface of the ink tank located near the first meniscus forming member 8

B and C: orthogonal projection distance (horizontal distance) of the slanting portions on both sides of the horizontal portion of the bottom surface H: height from the horizontal portion of the bottom surface of the ink tank to the level of a position on the upper end face of the ink tank where it contacts with the capillary member W: width of the ink tank at the level of the contact position D: depth of the ink tank at the level of the contact position The total value of A, B and C is 47.2 mm, while W is 49 mm. This indicates that the width of the ink tank (inside dimension) is gradually increased from the bottom to the top. Such a shape of the ink tank makes it easy to extract the product from the injection mold of synthetic resin. Incidentally, the angle α of the slanting surface is selected to be 15°; α=15°.

The dimensions of a specific example of the capillary member (FIG. 3), which is inserted into the ink tank, are: a=10 mm; b=20 mm; c=20 mm; h=62 mm; t=4 mm; and w=50 mm, where a: width of the protruded portion 3*a* b and c: orthogonal projection distance (horizontal distance) of the slanting portions on both sides of the protruded portion 3*a* h: height from the top (bottom in the drawing) of the protruded portion 3*a* to the top of the capillary member t: height from the root of the protruded portion 3*a* to the top thereof w: width of the upper end face of the capillary member d: depth of the upper end face of the capillary member The depth d of the capillary member is substantially equal to or slightly larger than the depth D of the ink tank. Since $\beta=30°$, $\beta-\alpha=15°$. The material of the capillary member is polyester felt of which the density is 0.05 g/cm$^3$ (when the main ink chamber is filled with ink). The same material was used for the capillary member of the cases of FIGS. 4 and 5.

Figure 6A:
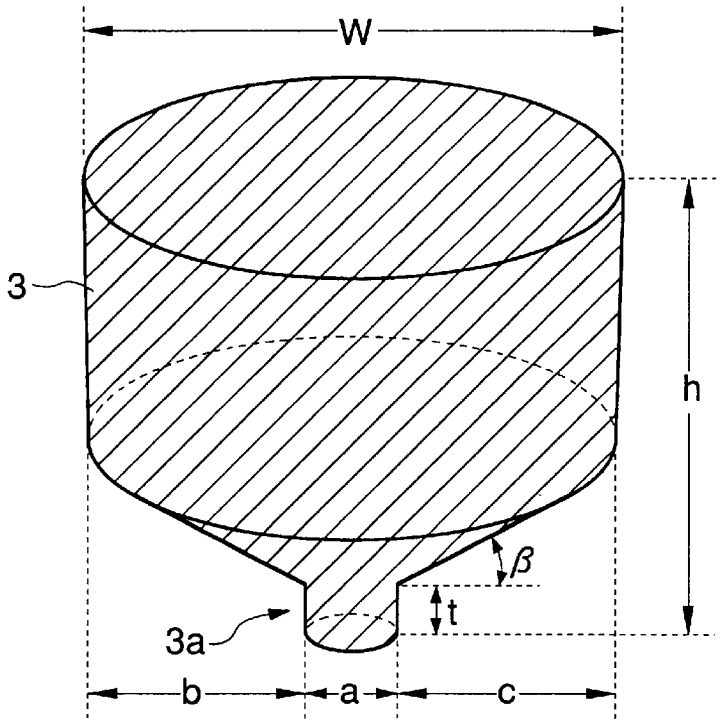
FIGS. 6(A) and 6(B) are a capillary member and a main ink chamber, respectively, according to a second embodiment of the present invention.
Figure 6B:
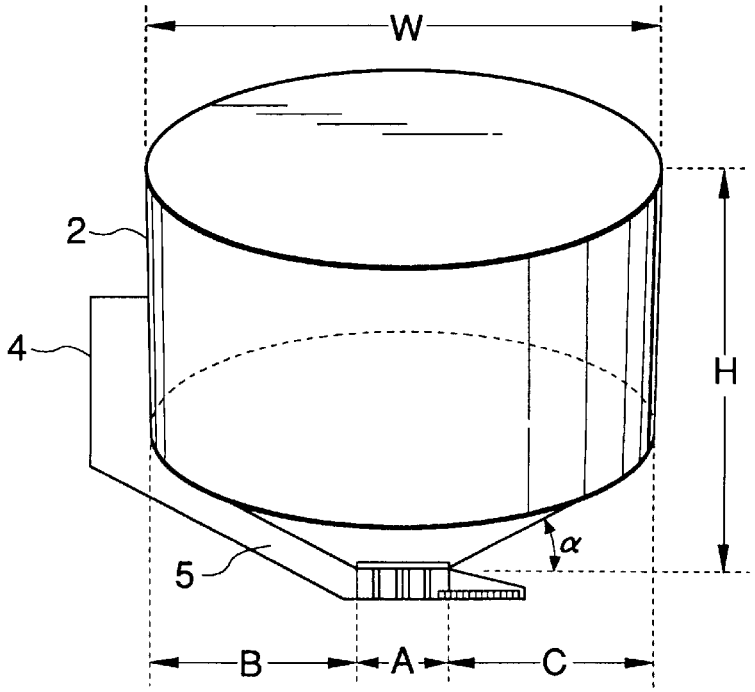

FIG. 6 shows a capillary member and a main ink chamber according to a second embodiment of the present invention. FIG. 6(A) is a view schematically showing the capillary member, and FIG. 6(B) is a view schematically showing the main ink chamber. In those figures, like or equivalent portions are designated by like reference numerals in FIGS. 1 through 3. As shown, in this embodiment, the main ink chamber 2 consists of a cylindrical part and a truncated cone part continuous to the bottom of the cylindrical part. The capillary member 3 to be inserted into the main ink chamber consists of a large cylindrical part, a circular cone part continuous to the bottom of the large cylindrical part, and a small cylindrical part continuous to the bottom of the circular cone part. The angle $\alpha$ of the slanting surface of the truncated cone part of the main ink chamber 2 is smaller than the angle $\beta$ of the slanting surface of the circular cone part of the capillary member 3; $\alpha<\beta$. In the combination of the main ink chamber and the capillary member, both being thus shaped, an ideal density gradient is formed in the capillary member such that the density is peaked at the location in the capillary member where is right above the through-hole, and is gradually decreased as the distance from the through-hole increases. With the density gradient, an efficient supply of ink is realized with the least of the final residual ink.

The dimensions of a specific example of the main ink chamber 2 (FIG. 6(B)):

A=8.4 mm; B=19.4 mm; C=19.4 mm; H=49 mm; and W=49 mm, where A: diameter of the truncated face of the truncated cone part of the main ink chamber 2, which is located near the first meniscus forming member B and C: orthogonal projection distance (horizontal distance) of the slanting portions on both sides of the truncated face H: height from the truncated face of the truncated cone part to the position on the upper surface of the main ink chamber where it contacts with the capillary member W: width of the upper surface of the cylindrical part The total value of A, B and C, viz., the diameter of the lower surface of the cylindrical part, is 47.2 mm, while the diameter W of the upper surface of the cylindrical part is 49 mm. This indicates that the diameter of the ink tank (inside dimension) is gradually increased from the bottom to the top. Such a shape of the ink tank makes it easy to extract the product from the injection mold of synthetic resin. Incidentally, the angle $\alpha$ of the slanting surface is selected to be 15°; $\alpha=15°$.

The dimensions of a specific example of the capillary member (FIG. 6(A)), which is inserted into the ink tank, are:

a=10 mm; b=20 mm; c=20 mm; h=62 mm; t=4 mm; and w=50 mm, where a: diameter of the truncated cone part 3*a* b and c: orthogonal projection distance (horizontal distance) of the slanting portions on both sides of the truncated cone part 3*a* h: height from the top (bottom in the drawing) of the truncated cone part 3*a* to the top of the capillary member t: height from the root of the truncated cone part 3*a* to the top thereof w: width of the upper surface of the capillary member Since $\beta=30°$, $\beta-\alpha=15°$.

The material of the capillary member of the present embodiment, as of the first embodiment, is polyester felt of which the density is 0.05 g/cm$^3$ (when the main ink chamber is filled with ink).

FIGS. 7 through 11 are explanatory diagrams for explaining an operation of the ink supply device according to the first embodiment of the present invention. In the figures, a print head connected to the joint port of the ink supply device is not illustrated for simplicity. The amounts of ink left in the device in some typical states of the ink supply device are illustrated the diagrams of (A) of FIGS. 7 to 11, and ink static pressures and ink dynamic pressures at these operation points are graphically illustrated in (B) of those figures. The term "ink static pressure" means an ink pressure when no printing operation is performed. The ink static pressure is caused by a pressure by a capillary force in the ink absorbing member or the meniscus forming member and the head pressure at the liquid level of ink. The term "ink dynamic pressure" may be expressed by the sum of an ink static pressure and a pressure loss caused by a flow rate of ink and a fluid resistance of ink in an ink flow path. The ink dynamic pressure that is plotted in the graphs was measured when a solid printing is performed.

Figure 7A:
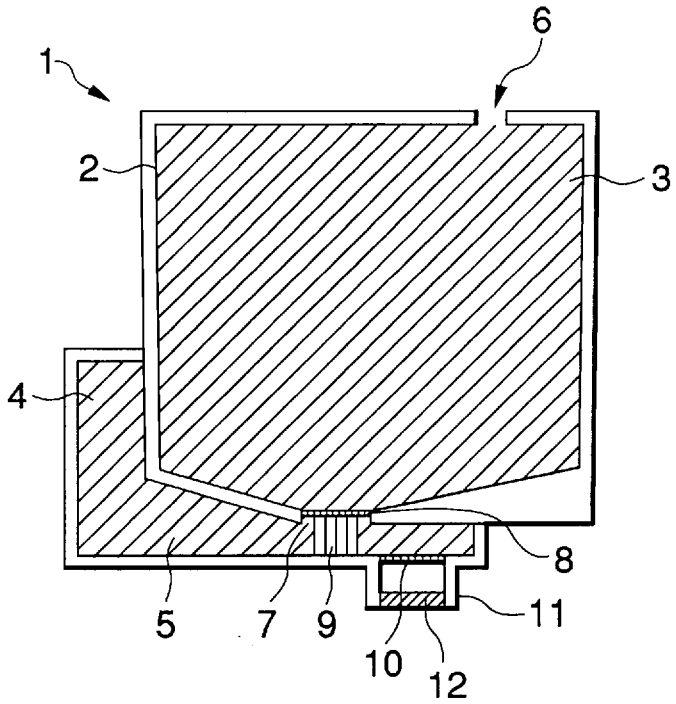
FIGS. 7(A) and 7(B) are explanatory diagrams showing an initial state in the operation of the ink supply device according to the first embodiment of the present invention.
Figure 7B:
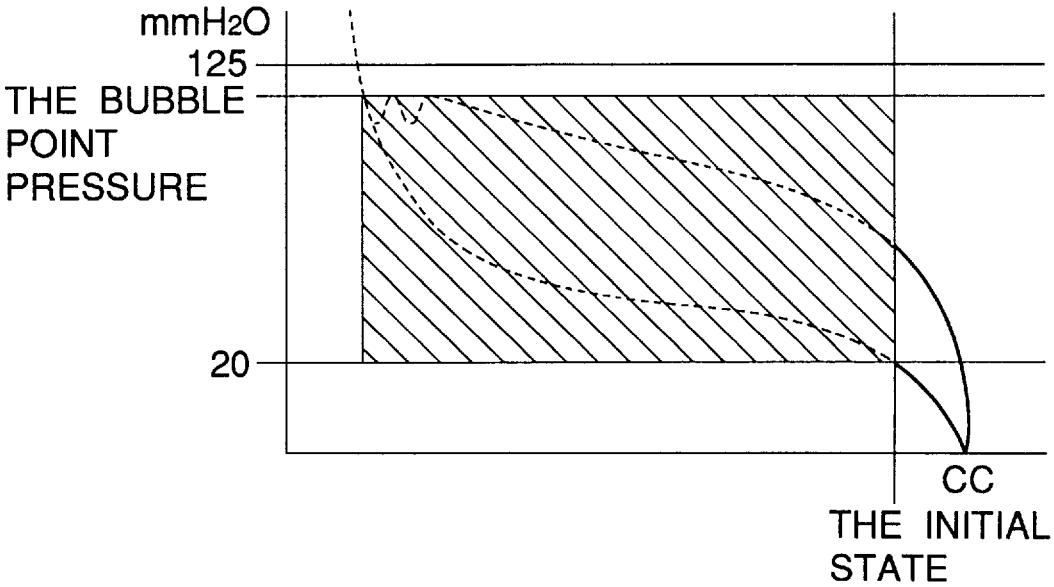

FIG. 7(A) is a view showing an initial state of the ink supply device (FIG. 1) in which it is filled with ink. In this state, the maximum amount of ink that can be held by the capillary force of the capillary member 3 is contained in the main ink chamber 2. At the start of the device operation, it is desirable to fill the main ink chamber 2 with ink in the light of the ink use efficiency. However, some space not filled with ink must be left in the capillary member 3 in order to generate a negative pressure by the capillary force of the capillary member 3. The intermediate ink chamber 4 is also filled with ink. In the description to follow, an initial ink pressure in the print head may be set at −20 mm$H_2O$, for example. In an initial state of the ink supply device before it is attached to the printer, the ink pressure is created by the capillary force of the capillary member 3, and ink is held therein. Ink in the intermediate ink chamber 4 and the path 5 also takes a negative pressure, and the negative pressure is maintained by the interface of ink formed in the minute holes of the second meniscus forming member 10. When the supply device is not used, the joint port 11 and the air hole 6 may hermetically be sealed with seals. In the sealed state, the ink supply device is packaged. When the ink supply device, or the ink tank 1, is used, the seals are removed and set to the image recording device or the printer. An ink static pressure and an ink dynamic pressure immediately after the ink tank is attached to the printer are shown in FIG. 7(B).

When the ink tank 1 is attached to the printer, sometimes some amount of air is left in the joint port 11. Under a pressure generated when the ink supply device is set, the air left pushes the interface of the ink that is formed in the second meniscus forming member 10, and enters in the form of air bubbles into the path 5. In the path 5, the air bubbles moves, by its buoyant force, along the slanting upper wall of the path 5, and accumulated in the intermediate ink chamber 4.

Figure 8A:
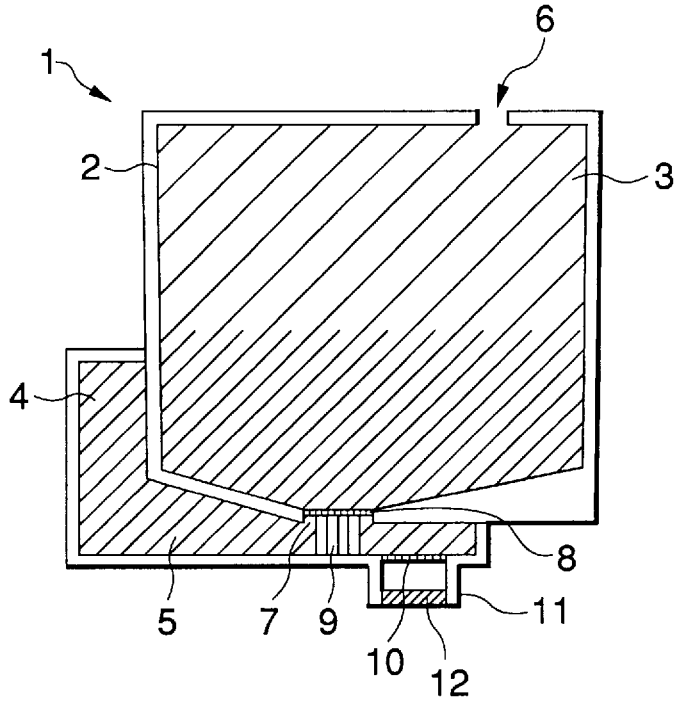
FIGS. 8(A) and 8(B) are explanatory diagrams showing an intermediate state in the operation of the ink supply device according to the first embodiment of the present invention.
Figure 8B:
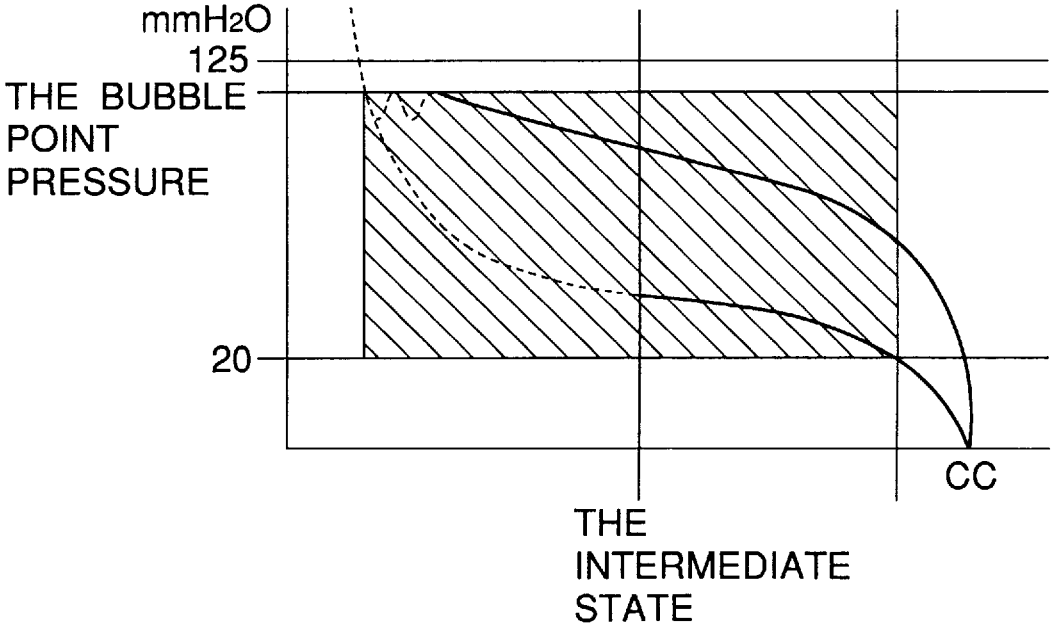

After the ink tank 1 is attached to the printer, the printing operation starts and the print head consumes ink. Then, as shown in FIG. 8(A), air gradually spreads into the capillary member 3 through the air hole 6 to the amount of consumed ink. With decrease of the ink held by the capillary member 3, the head pressure of ink decreases. As shown in FIG. 8(B), the negative pressure gradually decreases, but its increase progresses within a tolerable range. Even in a state that the amount of ink left is small, ink can be supplied by a stable negative pressure, with the aid of the capillary force of the capillary member 3. The ink held by the capillary member 3 smoothly moves to the path 5 through the first meniscus forming member 8.

In the ink supply when a normal print operation is performed, air that enters the main ink chamber 2 through the air hole 6 moves along the inner wall of the main ink chamber 2, and will enter the first meniscus forming member 8. However, only a slight amount of air succeeds in reaching the surface of the first meniscus forming member 8 because the bottom of the capillary member 3 is pressed against the bottom surface of the main ink chamber 2. The slight amount of air that reaches the surface of the first meniscus forming member 8 stays there, and the movement of ink continues. Also when air bubbles contained in ink pass through the capillary member 3 and air comes in contact with the upper face of the first meniscus forming member 8, the air can be trapped on the first meniscus forming member 8 if the filter particle size of the first meniscus forming member 8 is smaller than that of the capillary member 3. Accordingly, the ink movement continues. The movement of ink from the main ink chamber 2 to the intermediate ink chamber 4 is continued till the ink held by the capillary member 3 is reduced almost to zero.

Such a case that ink is forcibly sucked from the nozzles for maintenance work in a state that air bubbles are trapped on the surface of the first meniscus forming member 8, frequently occurs. In this case, the negative pressure generated is larger than in a normal case because of the forcible suction of ink. Also when much ink is consumed, for example, a solid printing is performed, a large negative pressure is frequently generated. In such a case, the air bubbles trapped on the surface of the first meniscus forming member 8 is infrequently pulled, together with ink, into the path 5. The air bubbles, which are pulled to the lower side of the first meniscus forming member 8 that is closer to the path 5, are united with other air bubbles to grow, and overflow the through-hole 7, and moves, by their buoyant force, to the intermediate ink chamber 4 along the slanting upper wall of the path 5. And the bubbles are accumulated in the intermediate ink chamber 4. Although the lower side of the first meniscus forming member 8 that is closer to the path 5 is covered with the air bubbles, the negative pressure is maintained by the surface tension of the interface of the ink formed in the minute holes of the first meniscus forming member 8.

Figure 9A:
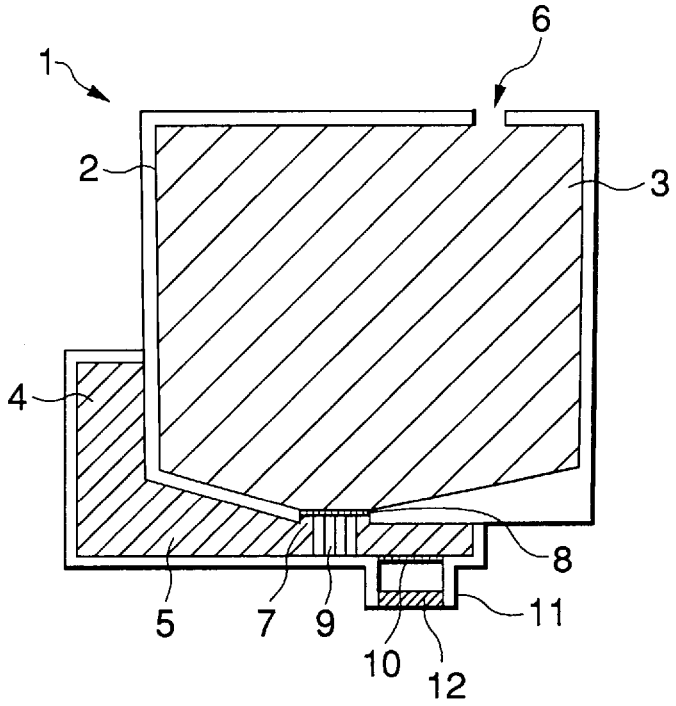
FIGS. 9(A) and 9(B) are explanatory diagrams showing a state that ink is reduced to zero in the main ink chamber, in the operation of the ink supply device according to the first embodiment of the present invention.
Figure 9B:
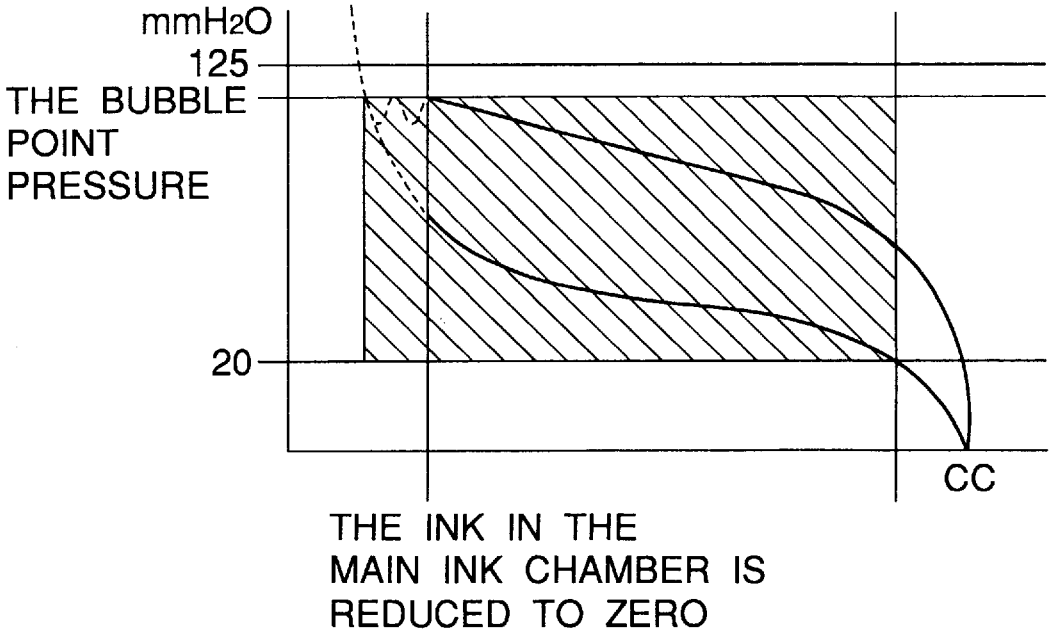
Figure 10A:
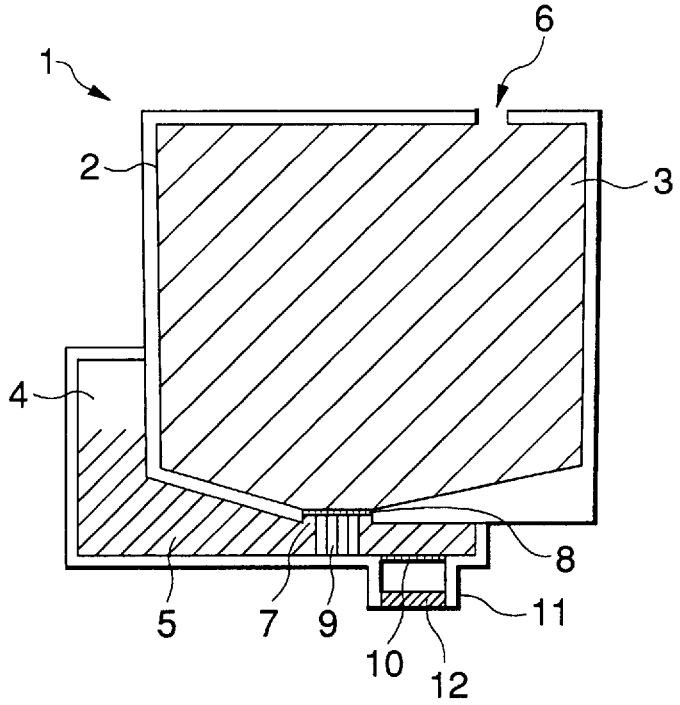
FIGS. 10(A) and 10(B) are explanatory diagrams showing a state that air bubbles are accumulatively stored in the intermediate ink chamber, in the operation of the ink supply device according to the first embodiment of the present invention.
Figure 10B:
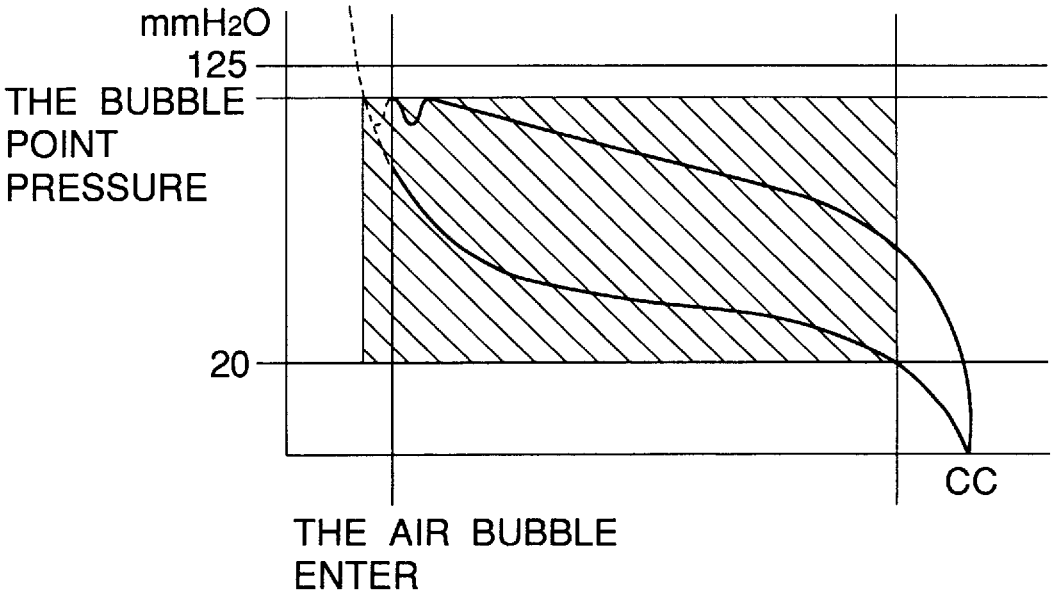

When the ink held by the capillary member 3 is reduced almost to zero, air comes in contact with the first meniscus forming member 8. This state is illustrated in FIG. 9. In this state, the interface of ink or the meniscus of ink is formed in each minute hole of the first meniscus forming member 8. As the ink is further consumed, the negative pressure is gradually increased, and a given negative pressure (bubble point pressure of ink determined by the filter particle size of the first meniscus forming member B) acts on the first meniscus forming member 8. At this time, air passes through the interface of ink or the meniscus of ink, and fine air bubbles appear on the lower side of the first meniscus forming member 8 that is closer to the path 5. The fine air bubbles are combined with air bubbles generated adjacent thereto and air bubbles later generated into large air bubbles, and those air bubbles move, by their buoyant force, to the intermediate ink chamber 4 along the slanting wall of the path 5. The movement of the air bubbles is smooth since the upper wall of the path 5 is slanted. The bubbles are moved to and gradually accumulated in the intermediate ink chamber 4. This state is shown in FIG. 10. The subsequent ink dynamic pressure is controlled by the first meniscus forming member 8, so that it is kept substantially constant till the ink is used up.

In a state subsequent to the state of FIG. 10, the upper and lower sides of the first meniscus forming member 8 are both exposed to air. The upper side of the first meniscus forming member 8 that is located closer to the main ink chamber 2 receives air coming in through the air hole 6 since ink in the main ink chamber 2 is reduced to zero. The lower side of the first meniscus forming member 8 is also exposed to air since air bubbles coming in through the first meniscus forming member 8 stay there to form an air layer thereon. However, the ink supply portion 9 sucks ink from the path 5 to the first meniscus forming member 8, thereby to keep the first meniscus forming member 8 wet. Ink films are formed in the first meniscus forming member 8. As a result, the negative pressure control after air bubbles are generated effectively operates.

When air bubbles are introduced into the lower side of the first meniscus forming member 8 that is closer to the path 5, the air bubbles move to the intermediate ink chamber 4 along the upper wall of the path 5 irrespective of presence or absence of ink in the main ink chamber 2, as described above. The air bubbles moves from through-hole 7 to the intermediate ink chamber 4. The ink supplied to the print head moves from the through-hole 7 to the joint port 11. Thus, the moving direction of the air bubbles is opposite to that of the ink. The result is a reliable separation of the ink from the air bubbles. Little air bubble enter the print head.

Figure 11A:
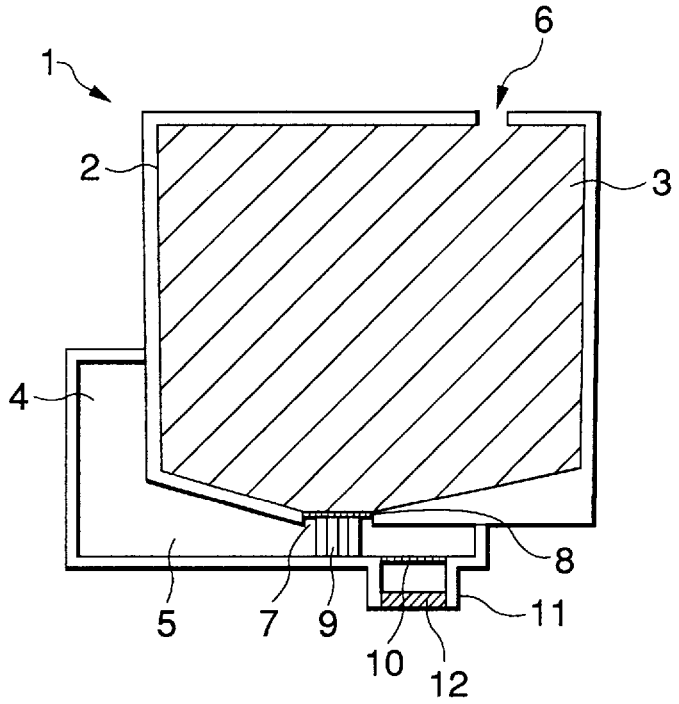
FIGS. 11(A) and 11(B) are explanatory diagrams showing a state that no ink is present in the ink tank, in the operation of the ink supply device according to the first embodiment of the present invention.
Figure 11B:
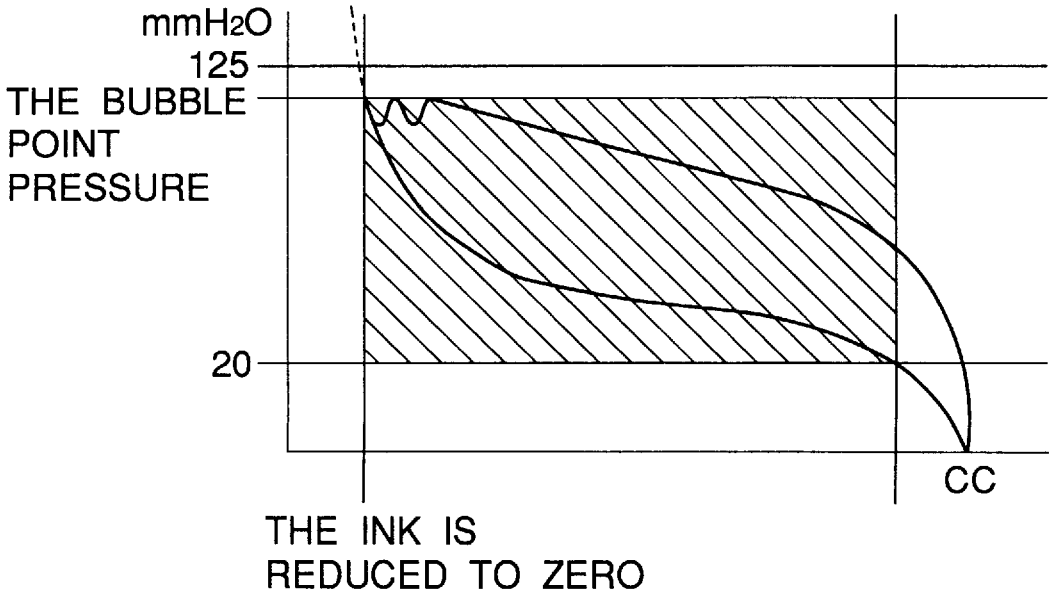

When air bubbles are introduced into the intermediate ink chamber 4 (FIGS. 9 and 10), the liquid level in the intermediate ink chamber 4 quickly drops because its volume is small. By making a part of the intermediate ink chamber 4 transparent, a state that ink in the intermediate ink chamber 4 is reduced almost to zero can be detected. So long as the ink is present in the main ink chamber 2, the intermediate ink chamber 4 is filled with ink or contains only a small amount of air. This state continues till the ink in the intermediate ink chamber 4 is reduced to zero, and most of the period of the ink tank 1 is placed in this state. When the ink in the main ink chamber 2 is reduced to zero, the amount of ink is rapidly reduced in the intermediate ink chamber 4. This fact enables one to detect the entire consumption of ink. Visual, optical and other means are available for this detection. In this way, control to a stable ink supply pressure is continued till the ink is reduced almost to zero in the intermediate ink chamber 4 and the path 5 (FIG. 11).

The above-mentioned approach to detect the quantity of the ink left therein, viz., at least a part of the intermediate ink chamber 4 is made transparent, may be substituted by an approach that the intermediate ink chamber 4 or the ink supply device are made entirely transparent. The latter approach is beneficial in that the number of required component parts is reduced and the hermetical sealing of the intermediate ink chamber 4 is easy.

Figure 12A:
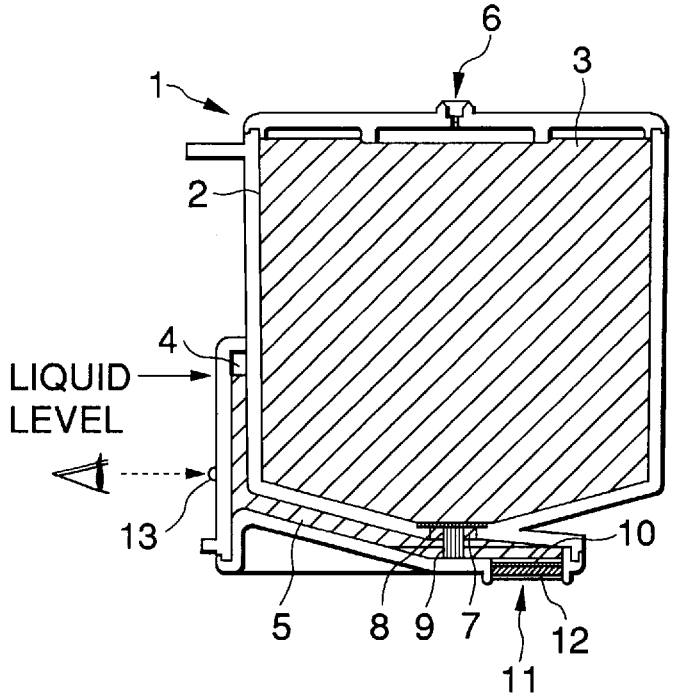
FIGS. 12(A) and 12(B) are cross sectional views showing a third embodiment of an ink supply device according to the present invention.
Figure 12B:
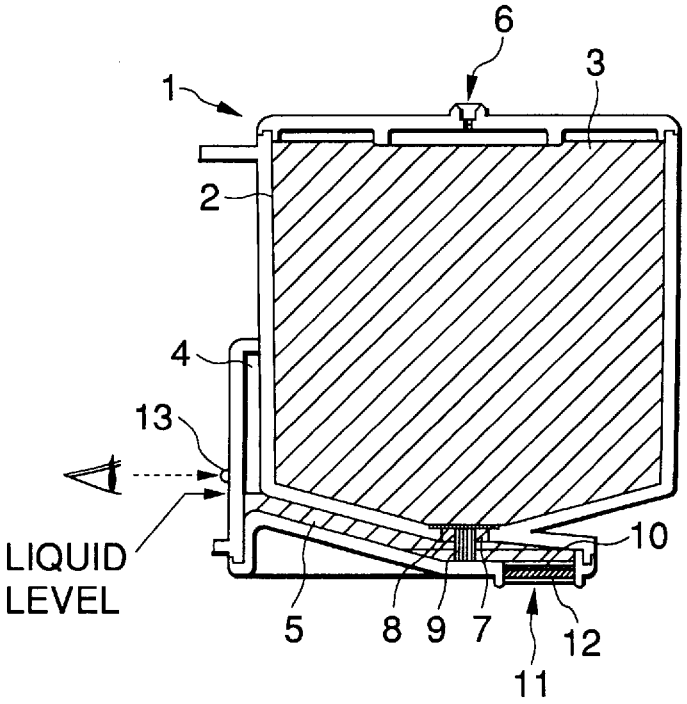
Figure 13A:
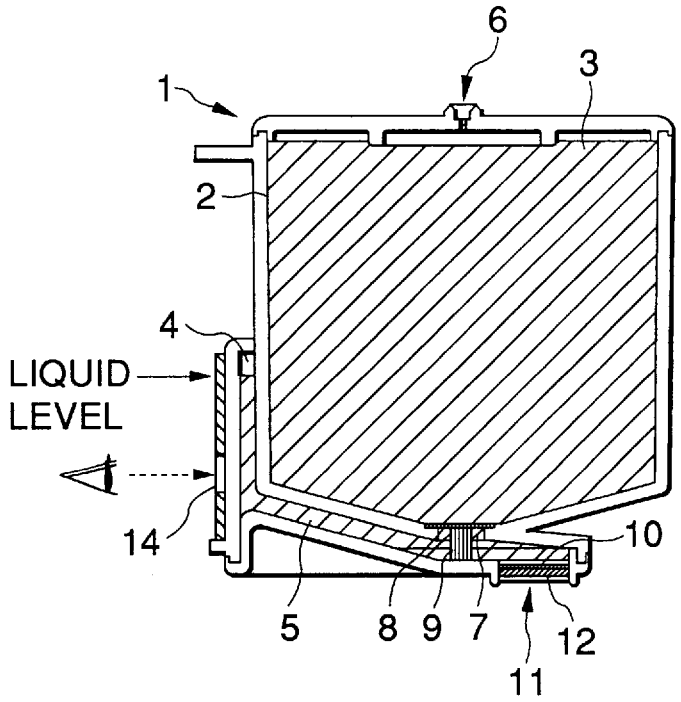
FIGS. 13(A) and 13(B) are cross sectional views showing a fourth embodiment of an ink supply device according to the present invention.
Figure 13B:
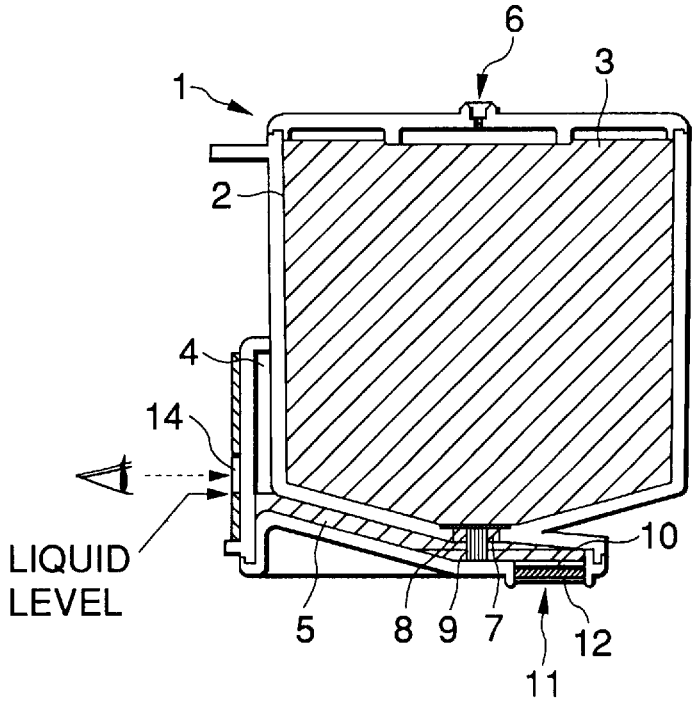

A small amount of air is accumulatively stored in the intermediate ink chamber 4 even in a state that ink is present in the main ink chamber 2. Where a visual inspection is used for checking the presence or absence of ink, an inspector may make the following mistakes. In such a state that an air layer is present but a small amount of ink is left in the main ink chamber 2, he sees only the air layer, and mistakenly recognizes that no ink is left. The problem is solved by a third and fourth embodiment of the present invention which are illustrated in cross sectional form in FIGS. 12 and 13. In the figures, reference numeral 13 designates a reference line, and numeral 14 indicates a window. The reference line 13 is marked at such a position that the liquid level of ink in the intermediate ink chamber 4 is off the reference line 13 so long as ink is left in the main ink chamber 2. Then, when ink is left in the main ink chamber 2, the liquid level is above the reference line 13 if air is present in the intermediate ink chamber 4. Accordingly, an inspector never makes the above mistake. When a state that no ink is left in the main ink chamber 2 and introduction of air bubbles is allowed, is set up, the liquid level goes below the reference line 13, to distinctively indicate that no ink is left in the main ink chamber 2. In the case of FIG. 13, the upper part of the intermediate ink chamber 4 is kept from sight by a covering means, while the window 14 is provided in only the area for inspection. With such a construction, the inspector cannot see the presence of air through the window 14 even if air is left in the intermediate ink chamber 4, so long as ink is left in the main ink chamber 2. The inspector never makes such a mistake that in a state that ink is left in the main ink chamber 2, he mistakenly recognizes that ink is used up. The window 14 may be realized in various ways. A first way is to stick an opaque seal with a window onto the outer wall of the intermediate ink chamber 4. A second way is to use a transparent material for only the window-located portion of the intermediate ink chamber 4 when it is manufactured.

When an indicator of the printer proper indicates "no ink is left", and the ink tank is replaced with a new one, the visual inspection is made to know the ink tank to be replaced. In this case, detection of only presence or absence in the ink tank suffices for this end, and no information on the amount of the left ink is required. For this reason, the detection of the amount of the left ink by the liquid level in the intermediate ink chamber may effectively be used.

The presence system in the ink tank is not affected by the variation of such ambient conditions as pressure and temperature because an atmospheric pressure that acts on the capillary member 3 through the through-hole 7 is equal to that received by the nozzle tips of the print head. The air accumulatively stored in the intermediate ink chamber 4 will be expanded or compressed when the ambient conditions vary. When the air in the intermediate ink chamber 4 is compressed, the negative pressure increases. However, the pressure increase is neutralized through the action as in the case of consuming ink. When the ink is expanded, the ink within the path 5 is moved through the first meniscus forming member 8 and absorbed by the capillary member 3. As a result, the negative pressure in the path 5 is kept constant. In either case, no problem arises because the amount of air in the intermediate ink chamber 4 is very small, and the volume of the main ink chamber 2 is much larger than that of the intermediate ink chamber 4.

Figure 14A:
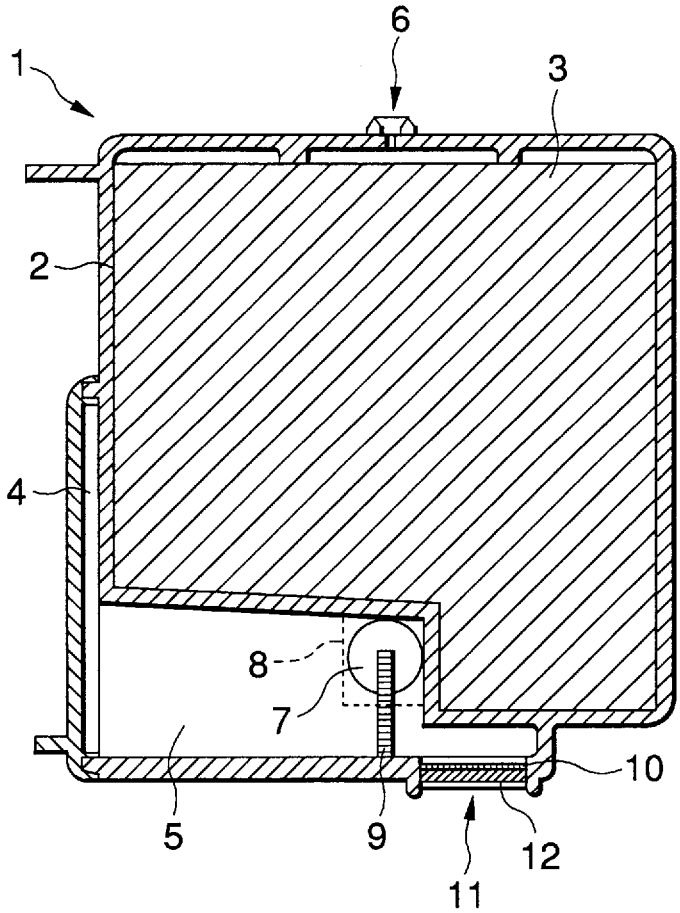
FIGS. 14(A) and 14(B) are cross sectional views showing a fifth embodiment of an ink supply device according to the present invention.
Figure 14B:
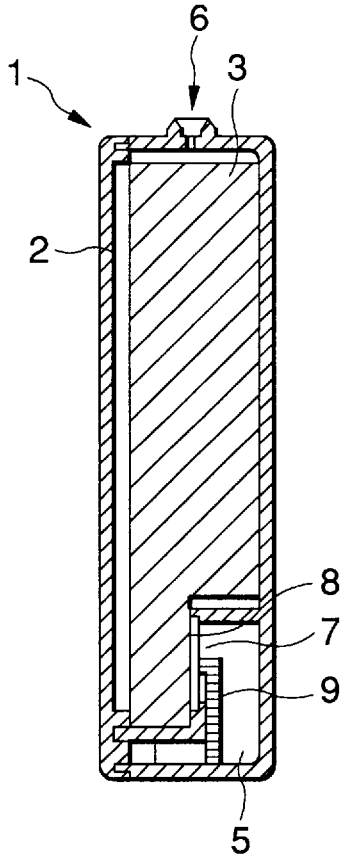

FIG. 14 is a cross sectional view showing a fifth embodiment of an ink supply device according to the present invention. In this embodiment, the first meniscus forming member 8 is vertically disposed. As in this embodiment, the through-hole 7 may be formed in the side wall, and the first meniscus forming member 8 may be vertically arranged. In this case, it is preferable to form the through-hole 7 at a location closer to the bottom of the main ink chamber 2. Further, the lower part of the first meniscus forming member 8 is located at the bottom of the path 5. In this case, the ink supply portion 9 is not used.

In the construction of the fifth embodiment, the ink tank 1 is vertically divided into the main ink chamber 2 and the intermediate ink chamber 4. The construction allows the intermediate ink chamber 4 to be exposed vertically. The air and the ink can be guided vertically and in the opposite directions. A reliable separation of ink from air is secured.

Figure 15A:
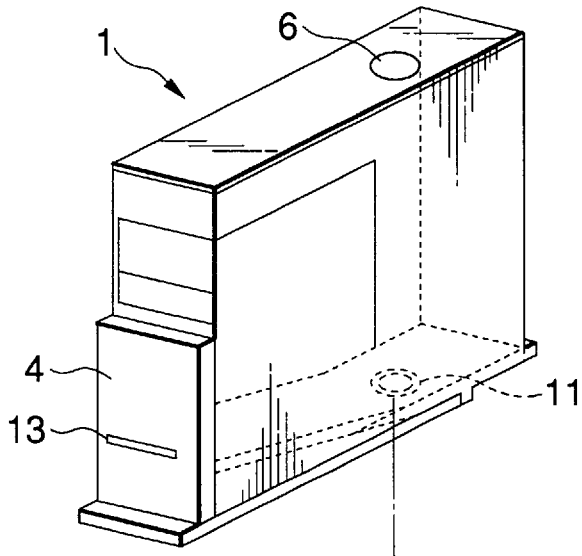
FIGS. 15(A) to 15(C) are perspective views showing an ink jet print head using the third embodiment of the ink supply device according to the present invention.
Figure 15B:
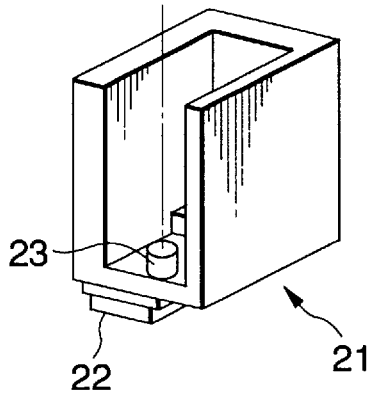
Figure 15C:
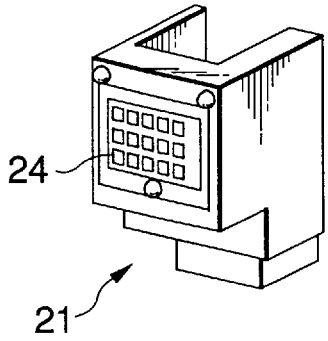

FIG. 15 is a perspective view showing an ink jet print head using the third embodiment of the ink supply device according to the present invention. In the figure, reference numeral 21 designates a print head unit; 22, a print head; 23, a joint; and 24, a connector. Thus, the print head unit 21 is made up of the print head 22, the joint 23, and the connector 24. The print head unit 21 is fixed to the carriage of the printer. The print head unit 21 may removably be mounted to the carriage or a part of it may removably be mounted to the carriage. The print head 22 may be of the ink-jet type or of the piezoelectric type. The connector 24 is electrically connected to the printer proper, and receives an electric power for driving the print head 22 to setting forth ink droplets, and control signals for controlling the operation of the print head.

The ink tank 1 is the ink supply device according to the third embodiment of the present invention. The ink tank 1 is entirely made of transparent material, and has the reference line 13 as shown in FIG. 12. The ink tank 1 is coupled with the print head unit 21 such that the joint port 11 of the ink tank 1 is tightly coupled with the joint 23 of the print head unit 21. A tight coupling of them may be realized by such a construction that a protruded portion is formed at the tip of the joint portion 11, and the joint 23 has an elastic receiving means for receiving the protruded portion of the joint port 11. To couple them, the tip with the protruded portion of the joint port 11 is forcibly inserted into the elastic receiving means of the joint 23. Ink supplied from the joint port 11 is supplied through an ink supply path, not shown, to the print head 22. A filter, if it is mounted in the middle of the ink supply path, filters off dust that will be mixed into the ink when the ink tank 1 is removed from the print head unit. The ink supplied is forcibly discharged through the nozzles within the print head 22 to a print paper for printing.

The ink tank 1 of the third embodiment of the present invention, used in this embodiment, may be substituted by any of the ink tans of the first, second, fourth and fifth embodiments of the present invention.

Figure 16A:
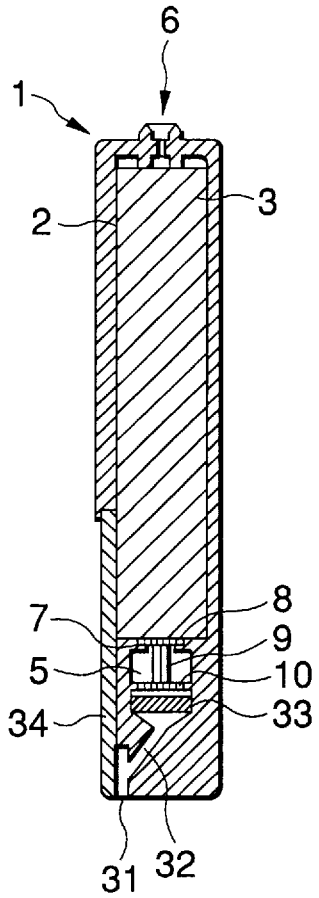
FIGS. 16(A) and 16(B) are cross sectional views showing a sixth embodiment of an ink supply device according to the present invention.
Figure 16B:
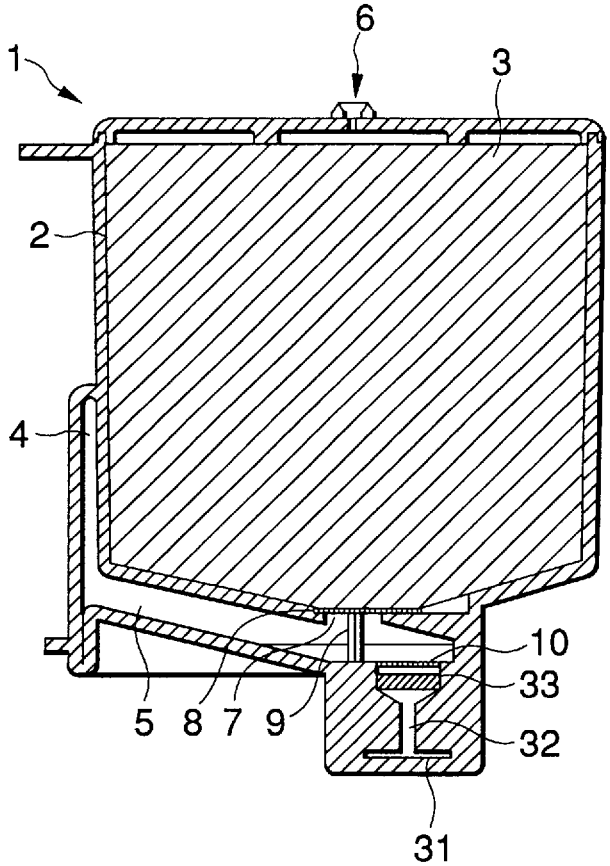
Figure 17:
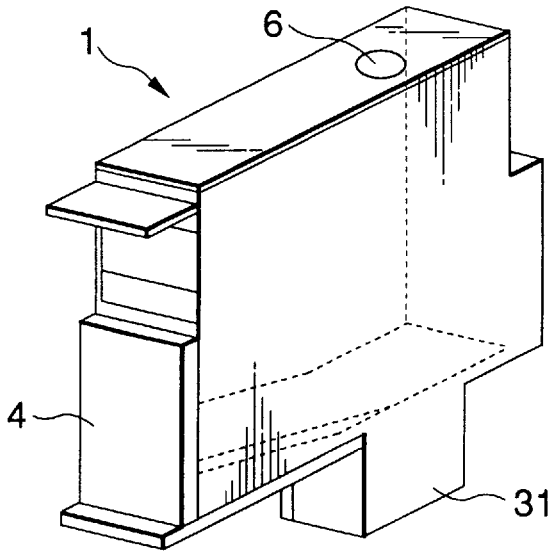
FIG. 17 is a perspective view showing the ink supply device of FIG. 16.

FIG. 16 is a cross sectional view showing a sixth embodiment of an ink supply device according to the present invention. FIG. 17 is a perspective view showing the ink supply device of FIG. 16. In those figures, like reference numerals are used for designating like or equivalent portions in FIG. 1. Reference numeral 31 designates a print head; 32, an ink supply path; 33, a filter; and 34, a radiating plate. In this embodiment, the capillary member 3 and the ink tank 1 are formed in one-piece construction.

The radiating plate 34 onto which the print head 31 is fastened, a printed circuit board for supplying electrical signals to the print head 31, and the like are disposed near the print head 31. The print head 31 includes a number of nozzles arrayed in high density. For example, 128 nozzles may be arrayed at 300 spi in density. In the construction illustrated in FIG. 16, ink droplets are shot forth downward.

One end of the path 5 connects to the path 5, while the other end connects to the through-hole 7 of the main ink chamber 2, and further to the ink supply path 32. With this arrangement of the paths and the hole, the direction of the flow of ink supplied through the through-hole 7 is opposite to the direction of the movement of air bubbles coming in through the through-hole 7. There is a less chance that air bubbles move to the ink supply path 32 and enter the print head 31.

The second meniscus forming member 10 is disposed in the connection part between the path 5 and the ink supply path 32. In this embodiment, unlike the first embodiment, it is not separated from the print head 31. It has only the functions of blocking the transmission of vibration, impact, pressure variation by acceleration to the ink tank 1 and the entering of air bubbles from the nozzle of the print head into the ink tank, and of removing dust. The filter 33 is located in the middle of the ink supply path 32. The filter 33 finally removes dust and air bubbles. The second meniscus forming member 10 and/or the filter 33 may be omitted.

Also in the present embodiment, like the third embodiment, the intermediate ink chamber may be marked with the reference line 13 and/or the window 14 as shown in FIGS. 12 and 13. Further, the first meniscus forming member 8 may be vertically arranged as shown in FIG. 14. Since the sixth embodiment is constructed such that the ink tank 1 is integral with the print head 31, the ink supply device of this embodiment is directly fastened to the carriage of the printer.

The operation of the ink supply device of this embodiment is similar to the operation of the ink supply device of the first embodiment after the ink tank is attached to the print head. This embodiment has no connection part, such as the joint port, in the middle of the ink flow path ranging from the main ink chamber 2 to the print head 31. Accordingly, air and dust are mixed into the ink when the ink tank is attached to or removed from the printer head. A good print is ensured. In a state that the ink supply device of this embodiment is removed from the printer, the negative pressure is maintained since the capillary force of the nozzles of the print head 31 balances that of the capillary member 3 in the main ink chamber 2. No ink leakage takes place.

Figure 18:
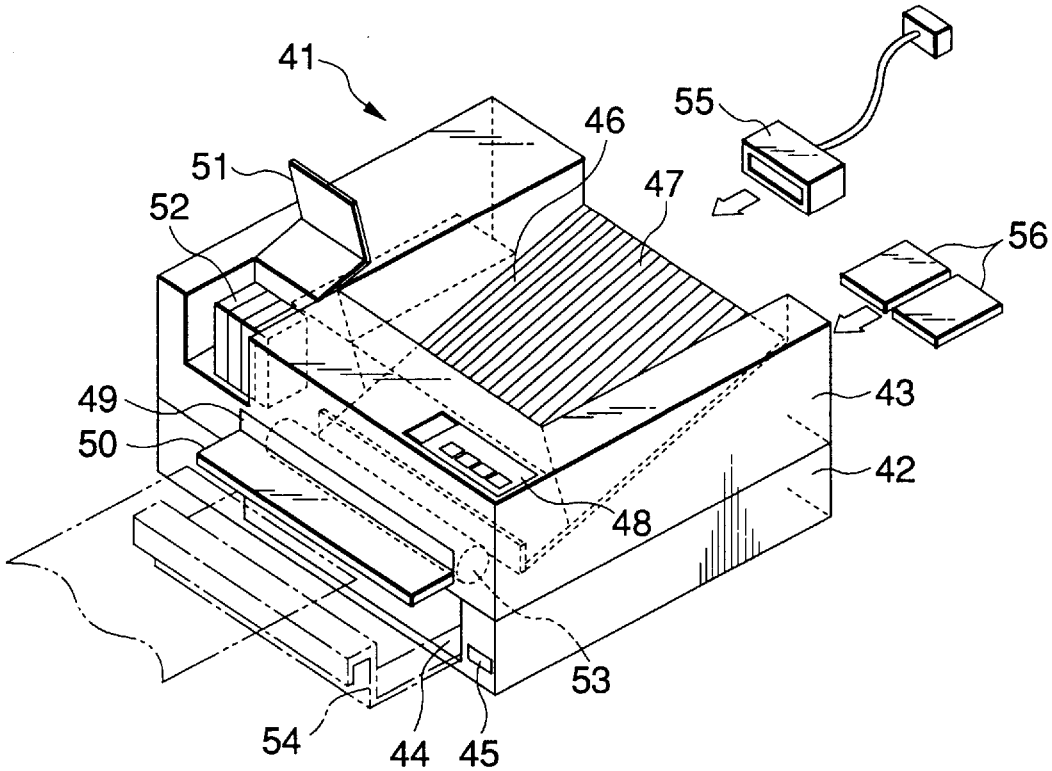
FIG. 18 is a perspective view showing an example of a printer.
Figure 19:
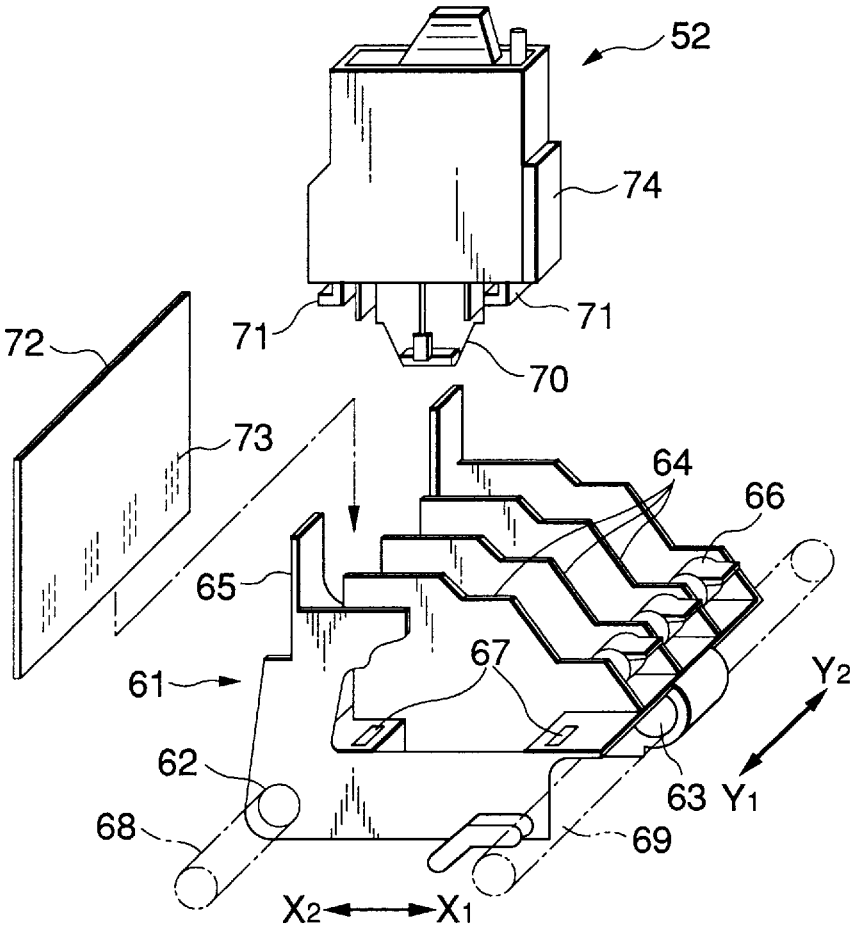
FIG. 19 is an enlarged view showing a portion of the printer to which the ink supply device is set.

FIG. 18 is a perspective view showing an example of a printer. FIG. 19 is an enlarged view showing a portion of the printer to which the ink supply device is set. In the figure, reference numeral 41 designates an image recording device (referred to as a printer); 42, a lower case; 43, an upper case; 44, a trap port; 45, a dip switch; 46, a main switch; 47, a paper receptacle; 48, a panel console; 49, a manual insert port; 50, a manual insert tray; 51, an ink cartridge cover; 52, an ink cartridge; 53, a paper feed roller; 54, a paper tray; 55, an interface cable; 56, a memory card; 61, a carriage; 62, a screw shaft through-hole; 63, a guide shaft through-hole; 64, a partition wall; 65, a rear wall; 66, a lock mechanism; 67, engaging grooves; 68, a screw shaft; 69, a guide shaft; 70, a print head; 71, engaging pieces; 72, a connection board; 73, a connection terminal; and 74, an intermediate ink chamber.

The case of the printer 41 includes the lower case 42 and the upper case 43. Electric circuit board, drive parts, and the like are contained in the case. The lower case 42 is provided with the tray port 44 into which the paper tray 54 containing a stack of print papers therein is inserted. Papers is fed from the paper tray 54 to the printer 41.

The dip switch 45 and the main switch 46 are attached to the lower case 42. The dip switch 45 is used for setting some functional operations of the printer 41. The functions infrequently used are allotted to the dip switch 45. When the dip switch 45 is not used, it is covered with a cover. The main switch 46 is a power switch of the printer 41. The lower case 42 further includes an interface connector, not shown, and a card insertion hole for the memory card 56, and the like. The interface connector receives the interface cable 55 which connects to an external computer for data transmission. The memory card 56 is used as an extension memory when the printer 41 operates, or stores fonts and used in print.

The upper case 43 is provided with the paper receptacle 47 which receives printed papers discharged from the printer. The panel console 48 includes input means, frequently used, for setting a print mode, and instructing paper feed, paper discharge, and the like, and display means for displaying messages from the printer. The manual insert port 49 and the manual insert tray 50 are used when a user manually feeds papers into the printer, by insertion.

The upper case 43 is provided with the ink cartridge cover 51. The ink cartridge 52 is attached to and removed from the printer, after this cover is opened. The ink cartridge 52 is any of the ink supply devices of the present invention already described. When the ink cartridge cover 51 is opened, a user sees the ink cartridge 52 from the front of the printer. The ink cartridge 52 is attached to the printer such that the intermediate ink chamber thereof is directed to the front. The user sees the intermediate ink chamber to inspect the presence or absence of ink left in the cartridge by the eye.

When the ink cartridge 52 is of the print-head contained type as of the sixth embodiment, it is removably set to the carriage 61 as shown in FIG. 19. The carriage 61 of FIG. 19 is partitioned into a plural number of compartments or slots by the partition walls 64. In this embodiment, it is partitioned into four slots. Accordingly, a maximum of four ink cartridges 52 may be set to the slots. The ink cartridge 52 is attached to the carriage 61 in a state that the print head 70 is directed downward, and the intermediate ink chamber 74 is directed to the front of the printer 41, viz., to the right when seen in the drawing. When inserted, the engaging pieces 71 of the ink cartridge 52 engage the engaging grooves 67. The lock mechanism 66 operates to lock the ink cartridge 52. An eccentric cam disc, for example, is used for the lock mechanism 66. A lever is turned to push the ink cartridge 52 in the direction X2 for locking. In the illustration of FIG. 17, the lock mechanism 66 of the leftmost slot (seen in the drawing) is omitted, and the wall defining the slot is partially broken away.

The connection board 72 is disposed between the rear walls 65 and the partition walls 64 of the carriage 61. Electronic parts, such as IC packages, are mounted on the connection board 72. A flexible cable, for example, is used for connecting it with a circuit board of the printer proper. The connection terminals 73 are provided on the connection board 72 in association with the ink cartridges 52. The ink cartridge 52 is loaded to the carriage, and the lock mechanism 66 operates to push it in the direction X2. Then, the terminal (not shown) of the ink cartridge 52 is coupled with the connection terminal 73.

The carriage 61 includes the screw shaft through-hole 62 and the guide shaft through-hole 63. The screw shaft 68 and the guide shaft 69 are inserted into those holes, respectively. The screw shaft 68 is rotatable with the aid of the bearing, and driven for rotation by a drive mechanism (not shown). The guide shaft 69 is fixed to the printer proper while being disposed in parallel with the screw shaft 68. With rotation of the screw shaft 68, the carriage 61 is horizontally moved in the direction of Y1 or Y2, along the guide shaft 69.

Papers are picked up sheet by sheet from the paper tray 54, and fed forward by the feed roller 53. The screw shaft 68 and the guide shaft 69 are arranged in parallel with the feed roller 53 (FIG. 18). The carriage 61 is horizontally moved in the direction orthogonal to the transporting direction of the paper. With the movement of the carriage, print is carried out every width of the print head 70. The paper is fed vertically, i.e., in its length direction to the next print position by the feed roller 53. Repeating this print process, a desired image is printed on the paper. The printed paper is discharged to the paper receptacle 47.

Figure 20:
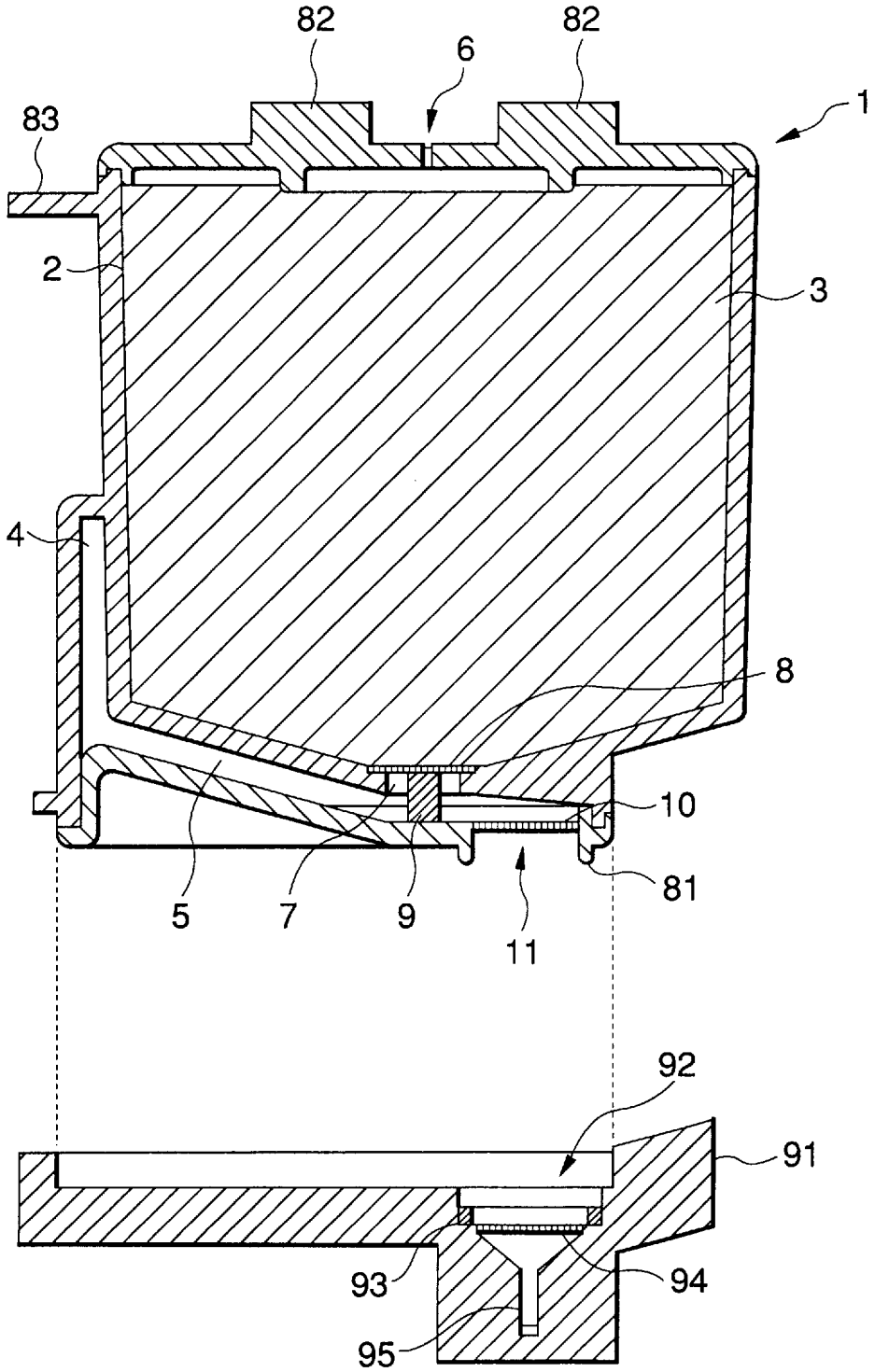
FIG. 20 is a cross sectional view showing an ink supply device with a unique device-attaching structure according to a seventh embodiment of the present invention.
Figure 21:
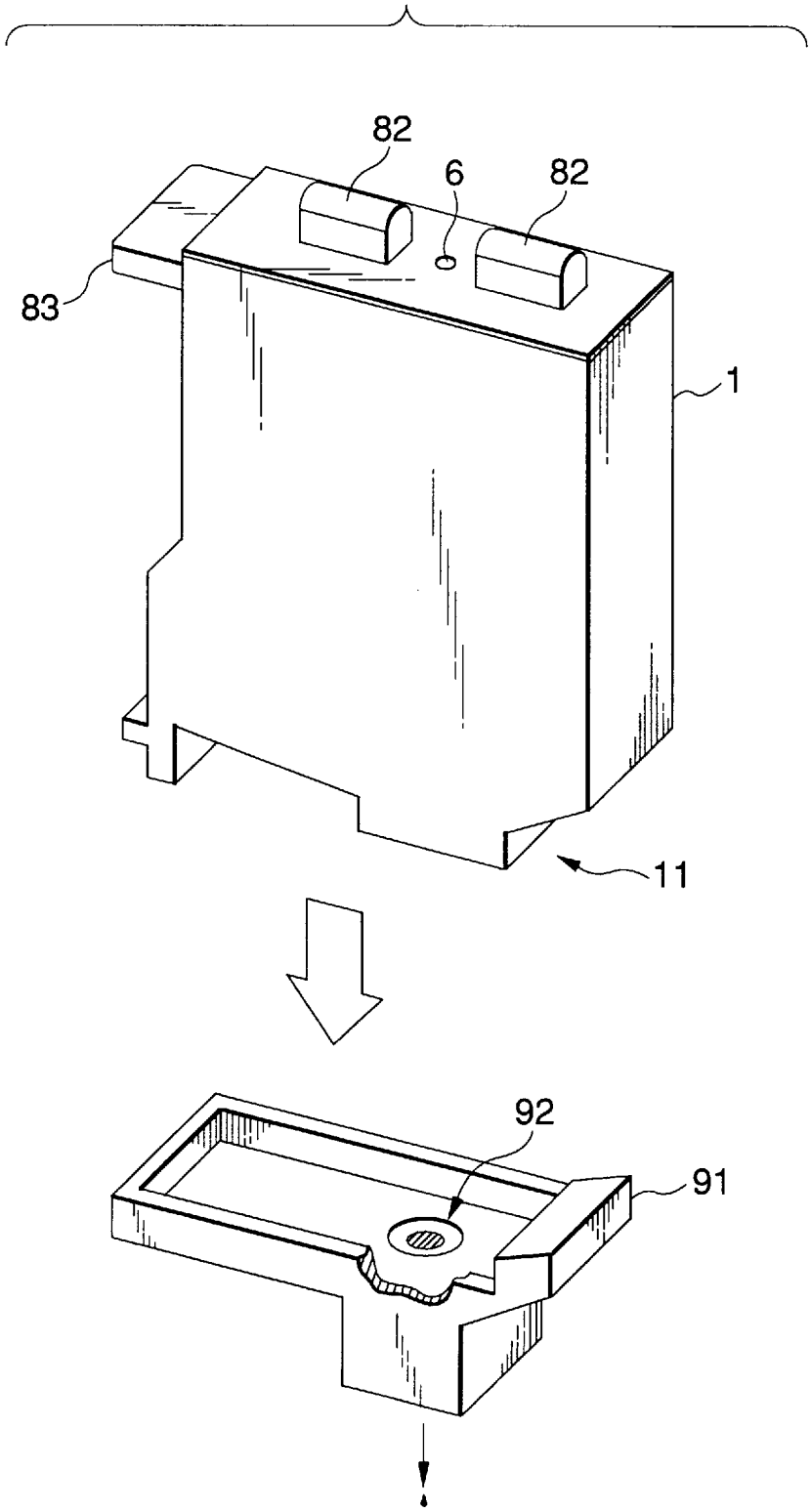
FIG. 21 is a perspective view showing a key portion of the ink supply device of FIG. 20.
Figure 22:
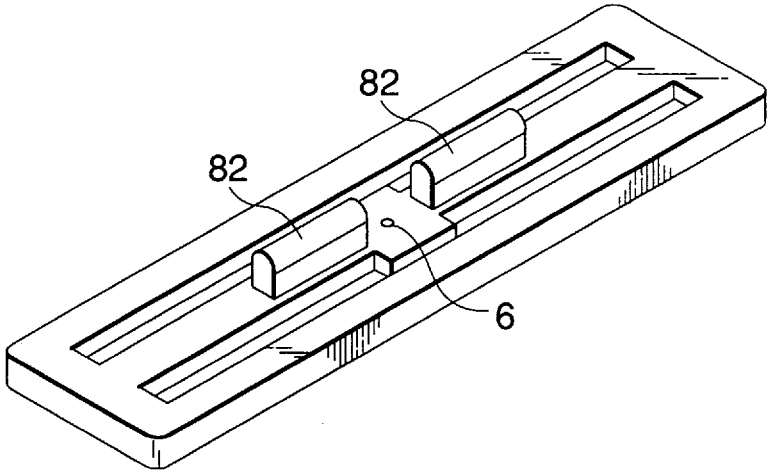
FIG. 22 is a perspective view showing the top of the ink supply device FIG. 20.

FIG. 20 is a cross sectional view showing an ink supply device with a unique device-attaching structure according to a seventh embodiment of the present invention. FIG. 21 is a perspective view showing a key portion of the ink supply device of FIG. 20. FIG. 22 is a perspective view showing the top of the ink supply device of FIG. 20. In those figures, reference numeral 81 designates protruded pieces; 82, a coupled of narrow projections; 83, a lug; 91, a print head; 92, an ink guide; 93, a packing; 94, a filter; and 95, an ink flow path. The ink supply device of the seventh embodiment of the invention is the same as the ink supply device of the first embodiment, which is of the type in which the ink tank is removably attached to the print head, except that the former is provided with the coupled of narrow projections 82.

The ink supply device in which the protruded pieces are disposed near the air hole 6 is known as disclosed in Published Unexamined Japanese Patent Application Nos. 6-91864, 6-126950, and 6-238883, for example. In those publications, the protruded pieces are located apart from the air hole 6 or the air hole 6 is formed in the protruded piece per se. When a user holds the protruded piece between his fingers to attach the ink tank to the print head, there is a chance of closing the air hold 6. Also in the case of the ink tank not having the protruded pieces, the user will push the ink tank from its top to attach it to the print head, and then there is the possibility that the air hole 6 is closed. Thus, the conventional structures for attaching the ink tank to the print head always suffer from the possibility that the air hole 6 is closed by the user. When the air hole 6 is closed, the pressure balance in the ink tank 1 is lost, and ink flows out of the joint port 11, so that the leaked ink will stain its near portions and adversely affect electric parts and components parts in the printer proper. Where ink of different colors are used, the leaked ink may mingle with another color ink. When the ink tank is attached to the print head, a pressure higher than the atmospheric pressure is possibly applied to the inside of the ink tank. In this state, ink may leak out of the joint portion or ink may spout from the nozzles. The seventh embodiment of the present invention has been made to solve the above-mentioned problems of the conventional structures for attaching the ink tank to the print head.

A couple of narrow projections 82 are disposed on both sides of the air hole 6, as shown in FIG. 22. The space between the narrow projections 82 is so selected as to reject a user's finger from entering therebetween. By so selecting the space, the air hole 6 will never be closed when the ink tank 1 is attached to and removed from the printer head. Particularly when the ink tank 1 is attached to the print head, the user usually holds the lug 83 between his fingers. Some users may push the top of the ink tank 1 with his finger against the print head, for the same purpose. In this case, the narrow projections 82 so spaced prevents the finger from closing the air hole 6. Accordingly, the following unwanted situations will never take place. Ink leaks from the joint port 11 when the ink tank 1 is handled. Ink leaks from the joint port 11 or nozzles when the ink tank 1 is attached. Further, air staying at the joint portion is introduced into the ink tank, thereby reducing the amount of air flowing into the print head.

As shown in FIG. 22, the narrow projections 82, each curved outward in cross section, are arrayed linearly. With provision of the narrow projections 82 thus shaped and arrayed, if the ink tank 1 is put upside down, it topples down. In other words, the ink tank 1 is placed usually in a state that the joint port 11 faces sideways or downward, and not upward. If the ink tank 1 is left along while the joint port 11 is directed upward, some problems arise. Dust will be accumulated on the joint port 11. The second meniscus forming member 10 disposed at the joint port 11 is dried, so that the meniscus formed sometimes is broken. The construction of FIG. 22 is free from such problems, however. In other words, the problems can be solved without any tax upon the user.

Figure 23A:
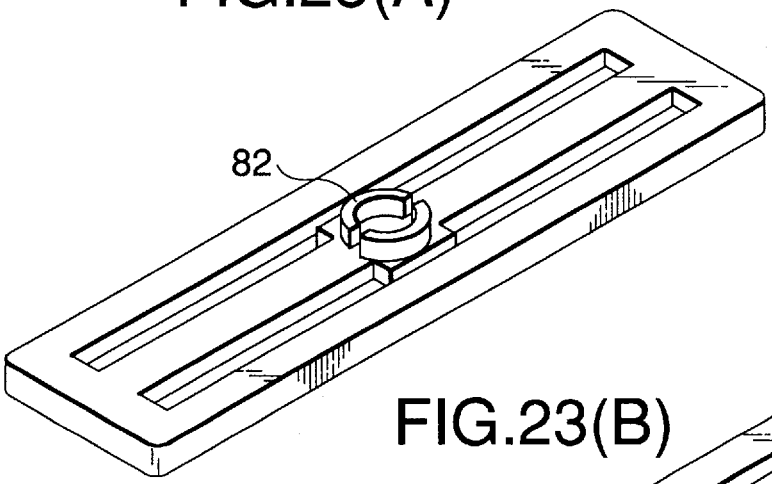
FIGS. 23(A) and 23(B) are perspective views showing other narrow projections used in the ink supply device of the present invention.
Figure 23B:
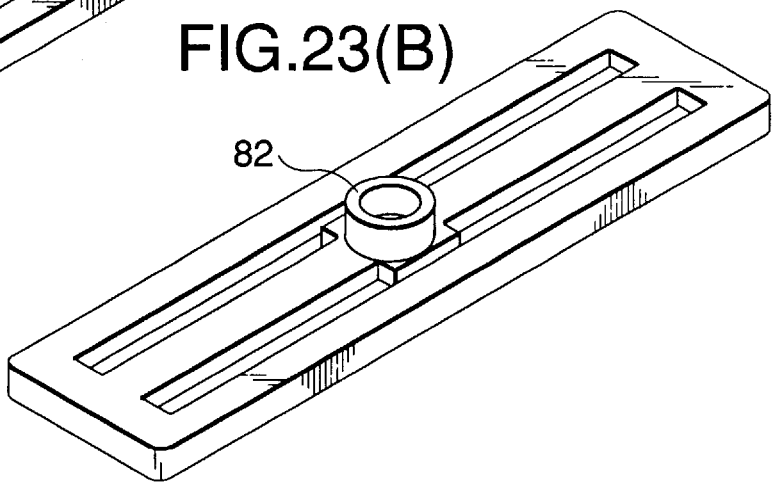

FIG. 23 is a perspective view showing other narrow projections used in the ink supply device of the present invention. In FIG. 23(A), a couple of projections 82, each semicircular in cross section, are disposed around the air hole 6 while being spaced from each other. In FIG. 23(B), a single ring-like projection 82 with an opening is disposed around the air hole 6. Each of the thus shaped projections secures an air path from the air hole 6 to the air if the top of the projections 82 is closed with the user's finger. Accordingly, no ink is leaked from the joint port 11 when the ink tank 1 is attached to the print head. It is evident that the projections 82 are not limited to those of FIGS. 22 and 23, but may take any other form other than those of FIGS. 22 and 23 if it is capable of preventing the closing of the air hole 6 by the finger of the user, for example. While the means for preventing the closing of the air hole 6 are applied to the ink supply device of the seventh embodiment of the present invention, those means may be applied to any of the first to sixth embodiments of the present invention.

In the case of the means for preventing the closing of the air hole 6 as shown in FIG. 23, when the ink tank 1 is put upside down, it can keep its inverted state since the tops of these means are flat. Also when the tops of the narrow projections 82 of FIG. 22 are shaped flat, the ink tank can keep its inverted state. Some possible measures to avoid this are to shift the gravity center of the ink tank 1, to decenter the air hole 6, and the like.

Figure 24:
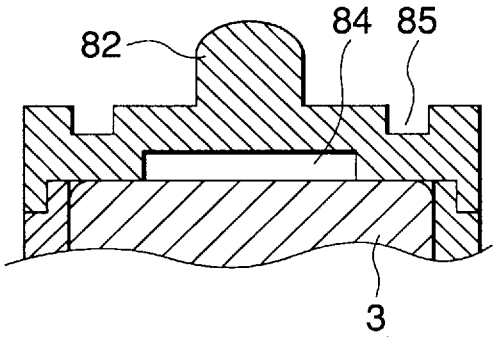
FIG. 24 is a cross sectional view showing an example of the upper portion of the main ink chamber.

FIG. 24 is a cross sectional view showing an example of the upper portion of the main ink chamber 2. In the figure, reference numeral 84 designates an air path portion, and 85 indicates a groove. Also shown in FIG. 20, the air path portion 84 is located between the lower surface of the top side of the main ink chamber 2 and the upper surface of the capillary member 3. The air path portion 84 distributes air that comes in through the air hole 6, over the entire upper surface of the capillary member 3. The circumferential edge of the top side of the main ink chamber 2 is jointed with the side wall of the main ink chamber 2. The top side of the main ink chamber 2 is thicker at the joint portion than the remaining portion thereof. However, the formation of the groove 85 reduces the thickness of the joint portion to be equal to that of the remaining portion of the top side of the main ink chamber 2, whereby the expansion and contraction of the top side of the main ink chamber 2 is made uniform over its entire top side. In the instances of FIGS. 22 and 23, two grooves are provided. The groove 85 are omissible, as a matter of course.

Returning to FIG. 20, the protruded pieces 81 are protruded downward from the edge defining the joint port 11. The packing 93 is located along the circumferential edge of the ink guide 92. Ink resistant material is preferable for the packing 93. Specific examples of such a material are silicon rubber or butyl rubber of hardness 30. The filter 94 is disposed in the ink flow path 95 ranging from the ink guide 92 to the nozzles. In a state that the ink tank 1 is removed from the print head, and left alone, dust will stick to the ink guide 92. To prevent the dust from entering into the ink flow path 95, the filter 94 is used. A mesh filter, made of stainless material, of which the filter particle size is 10 to 60 microns, may be used for the filter 94. A filter made of ceramic may also be used for the filter 94. A specific example of the filter 94 is a mesh filter of stainless steel, of which the filter particle size is 20 microns.

Figure 25:
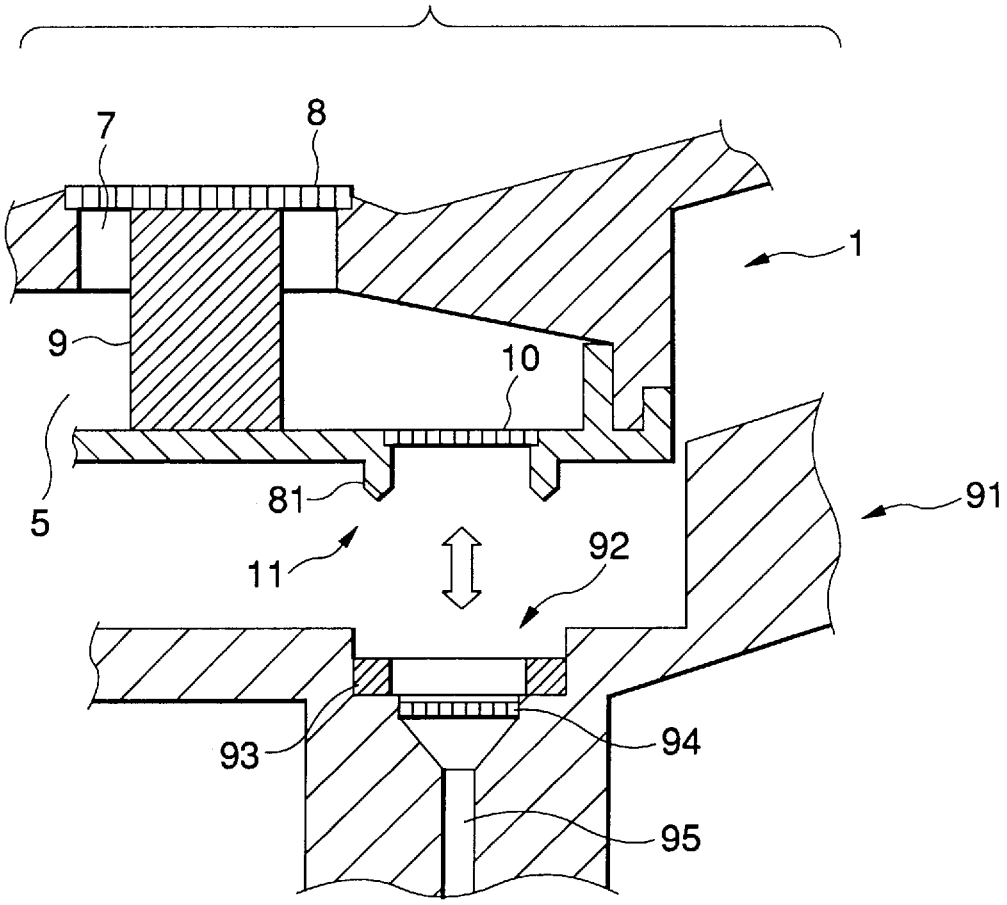
FIG. 25 is a cross sectional view showing the structure of the joint port and its near portions when the ink supply device of the seventh embodiment is removed from the print head.
Figure 26:
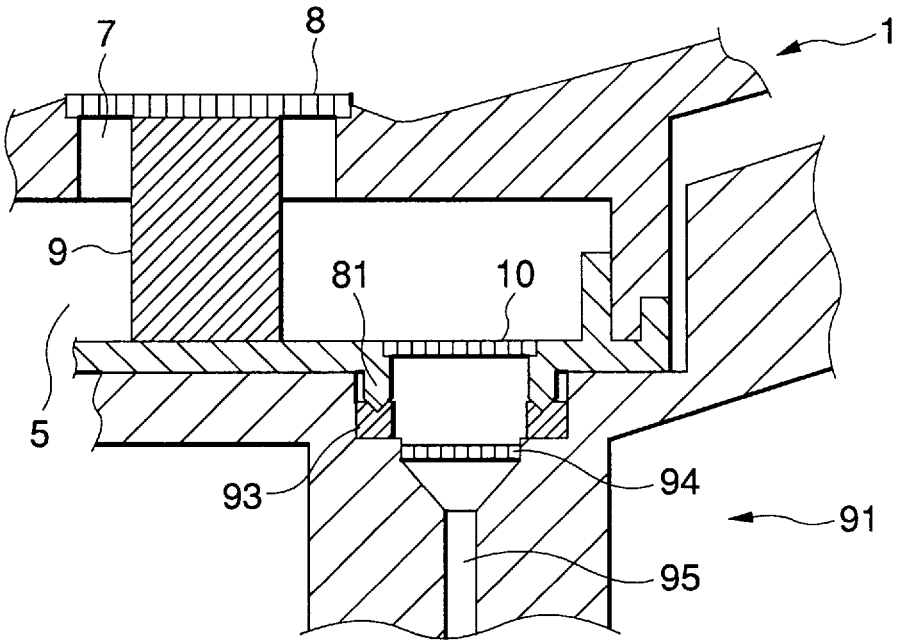
FIG. 26 is a cross sectional view showing the structure of the joint port and its near portions when the ink supply device of the seventh embodiment is attached to the print head.

FIG. 25 is a cross sectional view showing the structure of the joint port 11 and its near portions when the ink supply device of the seventh embodiment is removed from the print head. FIG. 26 is a cross sectional view showing the structure of the joint port 11 and its near portions when the ink supply device of the seventh embodiment is attached to the print head. The ink tank 1 is attached to the print head 91 at the joint port 11 and the ink guide 92. As described above, the protruded pieces 81 are protruded from the circumferential edge of the ink tank 1. The packing 93 made of rubber, shaped like a doughnut, is disposed in the ink guide 92 of the print head 91 in association with the protruded pieces 81 of the joint port 11. As shown in FIG. 26, when the ink tank 1 is coupled with the print head 91, the protruded pieces 81 of the joint port 11 are pressed against the packing 93, thereby hermetically closing the ink path. Under this condition, no ink is leaked from this joint portion. Ink flows to the print head 91, through the ink path of the joint portion.

The operation of the seventh embodiment is similar to those of the first to fifth embodiments, and hence no explanation of it will be given here. Provision of the projections 82 prevents the operator from closing the air hole 6 when the ink tank 1 is loaded. Accordingly, no ink leakage is caused. The hermetic joint at the joint portion by the protruded pieces 81 also prevents ink from leaking from the joint portion.

Figure 27:
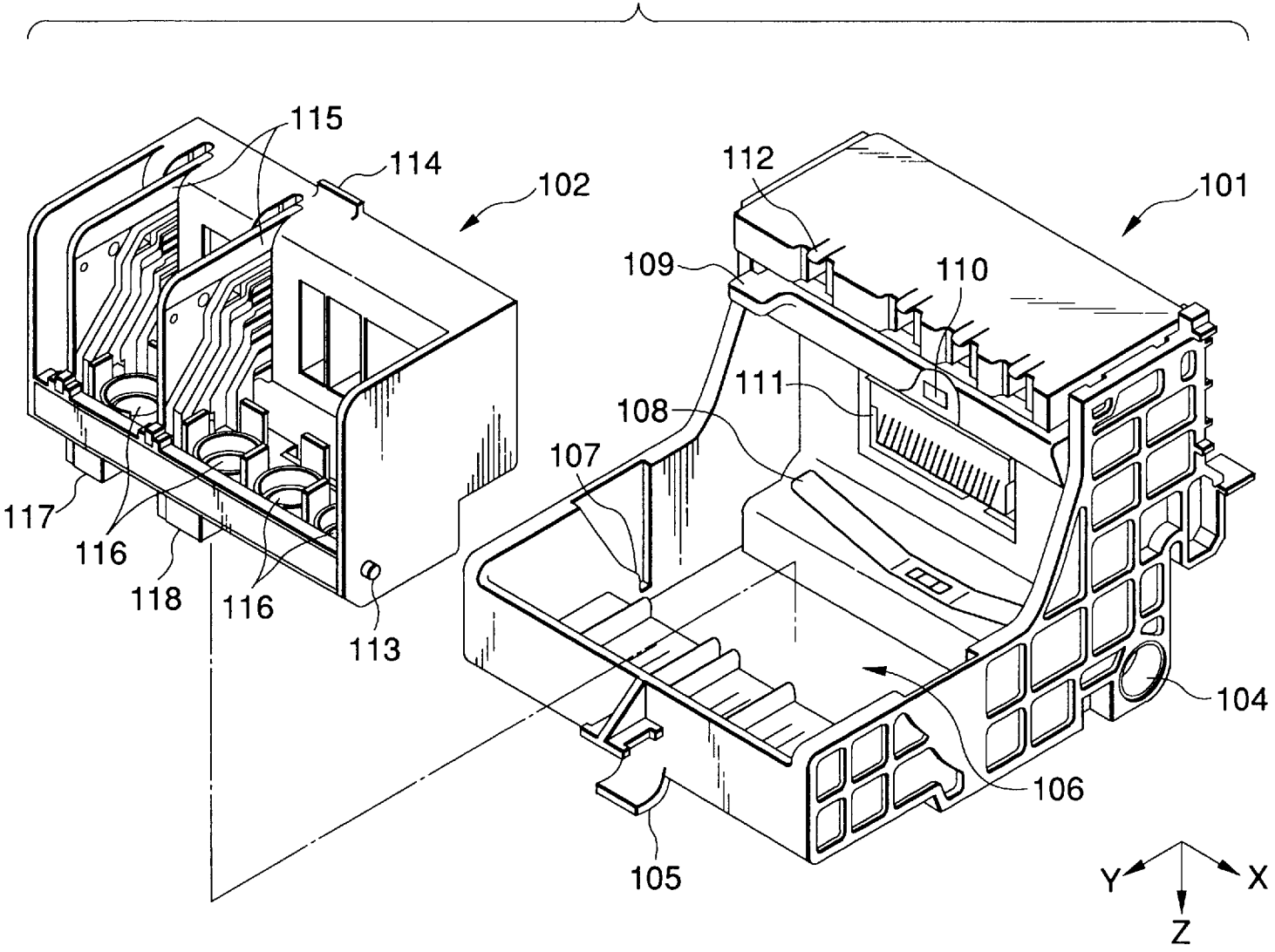
FIG. 27 is a perspective view showing a carriage before a print head unit is attached into the carriage, the ink supply devices of the seventh embodiment being set to the print head unit.
Figure 28:
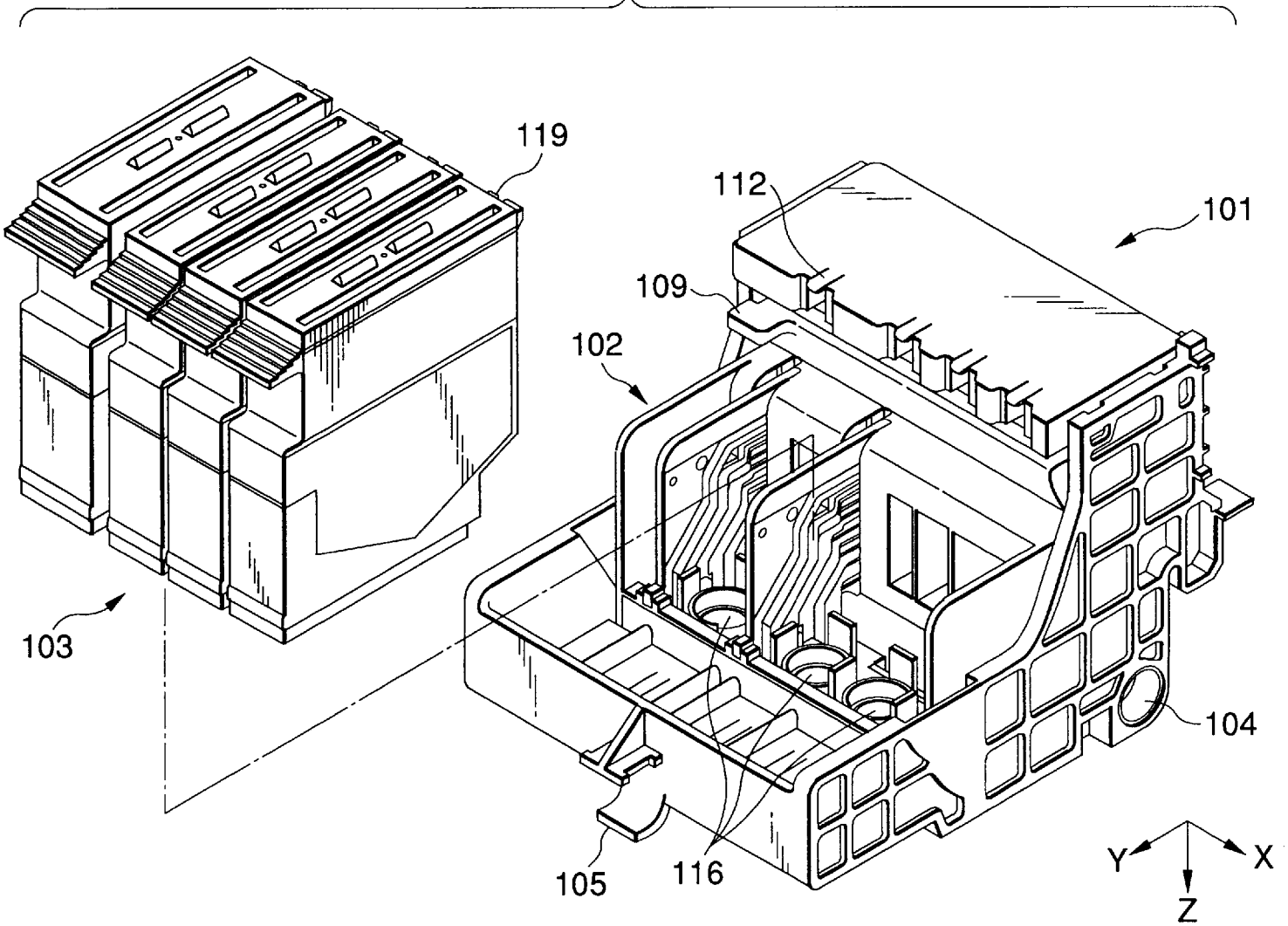
FIG. 28 is a perspective view showing the carriage with the print head unit attached thereto before the ink supply devices of the invention are set thereto.
Figure 29:
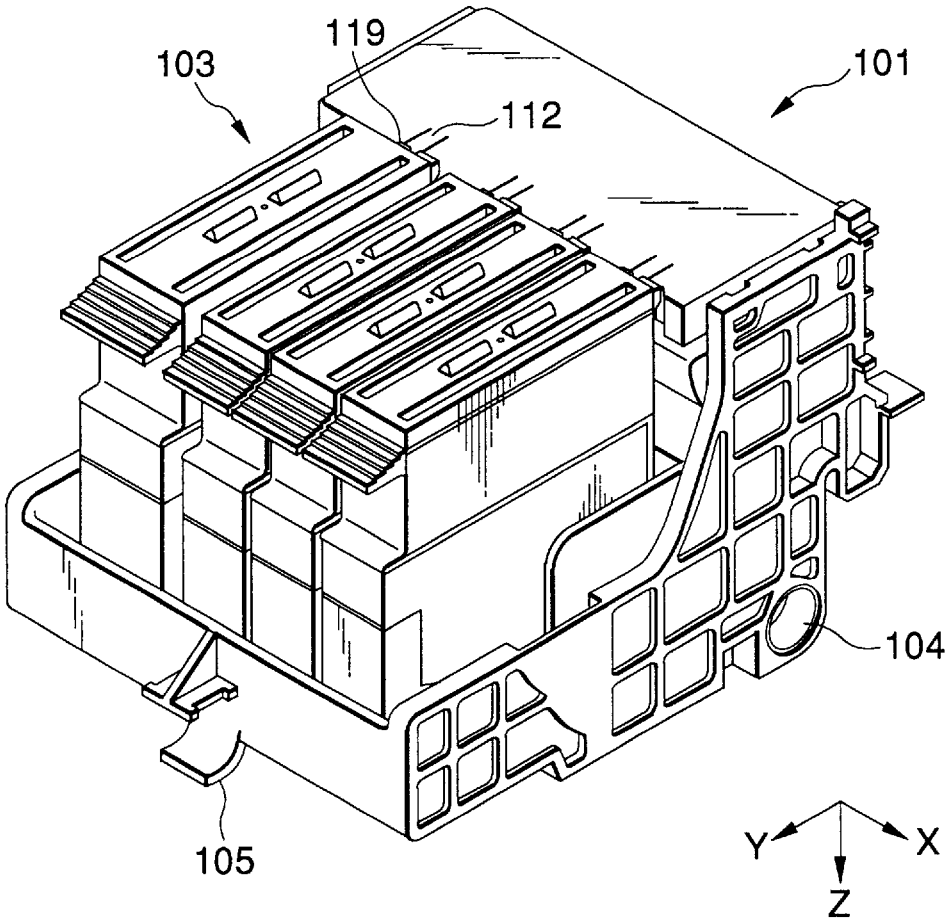
FIG. 29 is a perspective view showing the carriage with the print head unit attached thereto after the ink supply devices of the invention are set thereto.
Figure 30:
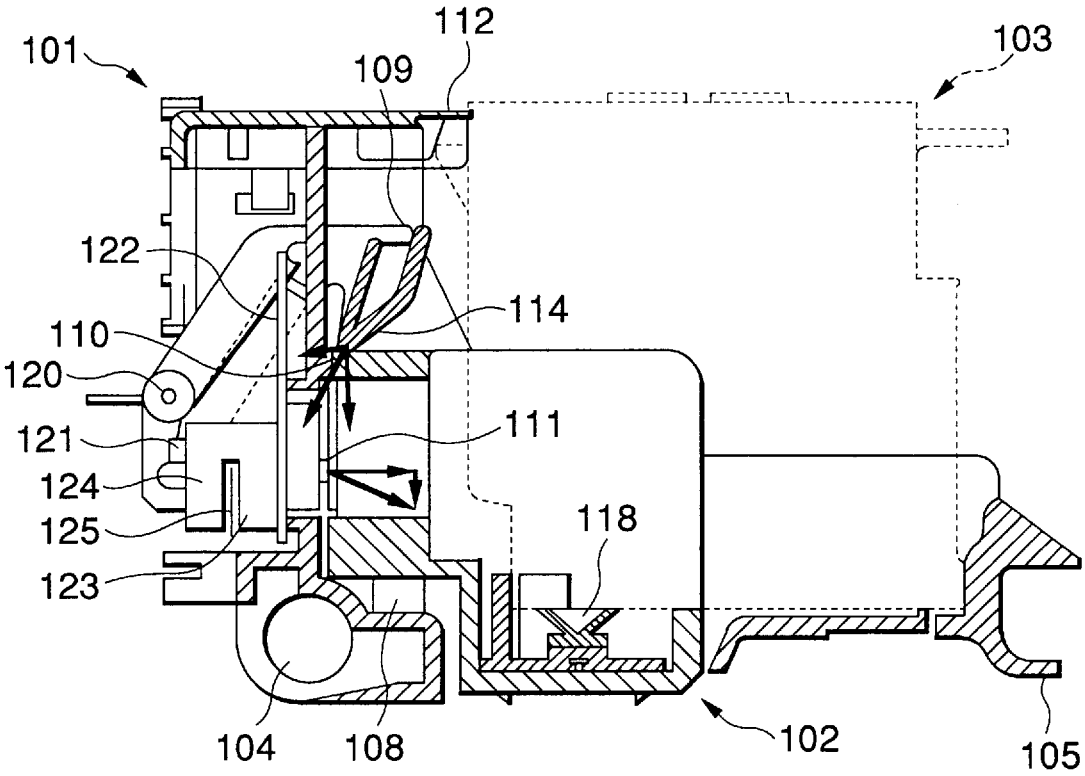
FIG. 30 is a cross sectional view showing the carriage with the print head unit attached thereto after the ink supply devices of the invention are set thereto.

FIGS. 27 through 29 perspectively illustrate an example of a carriage section into which the ink supply device of the seventh embodiment of the present invention is loaded. FIG. 30 is a cross sectional view showing the carriage section. In the figure, reference numeral 101 designates a carriage; 102, a print head unit; 103, an ink tank; 104, a shaft hold; 105, a guide plate receptacle; 106, an opening; 107, projection supports; 108, a plate spring; 109, a print head holder level; 110, a print head contact; 111, contact pins; 112, narrow strips; 113, a projection; 114, a print head fixing part; 115, a circuit board; 116, an ink guide; 117, a black print head; 118, a color print head; 119, coupling pieces; 120, a shaft; 121, a spring; 122, a contact board; 123, a connector; 124, a position sensor; and 125, a timing fence. An appearance of a printer into which the ink supply device is loaded is similar to that shown in FIG. 18, for example.

The carriage 101 is provided with the shaft hole 104 and the guide plate receptacle 105. The carriage 101 is movable along a main shaft and a guide plate of the printer proper that are respectively received by the shaft hole 104 and the guide plate receptacle 105. For assembling the print head unit 102 into the carriage 101, the carriage 101 includes the opening 106 formed in the central part of the carriage 101, the projection supports 107 on both side walls thereof, and the plate spring 108 mounted on the rear part of the bottom of the carriage. The print head holder level 109, as shown in FIG. 30, is rotatably mounted on the shaft 120 while being energized by the spring 121. When the print head unit 102 is put into the opening 106 of the carriage 101, the print head holder level 109 obliquely pushes the print head unit 102 against the print head contact 110, thereby urging it in the directions Z and -Y, as indicated by bold lines with arrows. When the print head unit 103 is inserted, the print head contact 110 comes in contact with the print head fixing part 114 of the print head unit 102, to thereby position the print head unit 102. In the illustration of FIG. 27, the print head holder level 109 is partly broken away so as to expose the print head contact 110 to view.

The contact board 122, as shown in FIG. 30, is provided on the rear side of the carriage 101. The contact board 122 is electrically connected to the printer proper by a flexible cable, for example. The contact board 122 has the connector 123 mounted thereon. The connector 123 is provided with the contact pins 111 for electrical connection with the print head unit 102. An electric power and various control signals are supplied from the printer proper to the print head unit 102, through this contact pins 111. The contact board 122 further includes the position sensor 124 for detecting a mark on the timing fence 125.

The narrow strips 112 are tightly coupled with the coupling pieces 119, thereby holding the ink tank 103. The pushing force of the narrow strips 112 pushes the ink tank 103 to the ink guide 116 of the print head unit 102, so that the joint portion between the ink tank 103 and the print head unit 102 is hermetically closed, to thereby set up a liquid path. Both sides of each of the narrow strips 112 are dented, and the width of each of the resultant dents corresponds to that of each of the coupling pieces 119. The coupling pieces 119 are inserted into the dents, thereby positioning the print head unit 102 in the directions X and -Y.

The print head unit 102 is provided with the ink guides 116 which respectively communicate with the ink tanks 103 of different colors, and receiver color ink from the associated ink tanks. In this instance, four ink guides 116 are provided, one for black ink, and the remaining ones for three-color inks. Black ink is received by its ink guide 116, and supplied to the black print head 117, and the remaining color ink are supplied to the color print head 118. Arrays each consisting of a number of nozzles are disposed on the black print head 117 and the color print head 118, respectively. The black print head 117 is capable of printing a black image by using all of the nozzles arrayed. In the color print head 118, the arrayed nozzles are divided into three groups for three colors. A color image is printed by using these three groups of the nozzles. Nozzles not used may be used. Drive circuits for driving the black print head 117 and the color print head 118 are printed on the circuit boards 115, which are electrically connected to the contact pins 111 of the carriage 101. In this instance, two circuit boards are used in connection with the heads. The circuit boards 115 may be made of metal. In this case, the metal boards are used as heat sink for the black print head 117 and the color print head 118. Projection 113 are formed on the sides of the print head unit 102. The print head fixing part 114 is provided on the upper surface of the print head unit 102. These are used when the print head unit 102 is attached to the carriage 101. In this case, the projections 113 are put in the projection supports 107, whereby the print head unit 102 is positioned and held. The print head fixing part 114 is brought into contact with the print head contact 110 of the carriage 101, and is firmly held by the print head holder level 109.

To attach the print head unit 102 to the carriage 101, the print head holder level 109 is turned by pulling it up so that the black print head 117 and the color print head 118 of the print head unit 102 are seen through the opening 106 of the carriage 101. In this state, the print head unit 102 is inserted into the carriage 101 from above. When the print head unit 102 is somewhat inclined, an easy insertion is realized. The projections 113 of the print head unit 102 are respectively inserted into the projection supports 107, and come in contact with the bottom thereof, to thereby position the fore side of the print head unit 102. Further, the print head fixing part 114 is brought into contact with the print head contact 110 of the carriage 101, and the print head holder level 109 is released. Then, the print head holder level 109 urges the carriage 101 in the directions Z and -Y. The directions of the forces at this time are indicated by bold lines with arrow in FIG. 30.

The contact pins 111 of the carriage 101 are electrically connected to the contact portion (not shown) of the print head unit 102. To secure a stable electrical contact, an urging force is required which urges the contact pins 111 against the contact portion of the print head unit 102. A reaction force of each of the contact pins 111 is approximately 80 gf. Where 15 signal lines, for example, are used, the total reaction force of the contact pins 111 is approximately 1.2 kgf. After the projections 113 of the print head unit 102 are inserted into the projection supports 107, the print head unit 102 is fixed by the print head holder level 109. As a result, the contact portion of the print head unit 102 is pushed by a preset force, thereby securing a stable electrical connection. The pushing force by the contact pins 111 is indicated by bold lines with arrows in FIG. 30.

It is known that when a component part is positioned and assembled, the most stable construction is obtained in a manner that it is positioned at three points on the first reference plane, it is positioned at two points on the second reference plane, and it is positioned at one point on the third reference plane. In the construction of this instance, for the positioning of the direction Y, the positioning is made by the print head fixing part 114 of the print head unit 102 and the print head contact 110 of the carriage 101, and another positioning is made by the projections 113 on both the sides of the print head unit 102 and the projection supports 107 on both the sides of the carriage 101. The pushing force by the print head holder level 109 and the reaction forces of the contact pins 111 are used for these positioning. The print head holder level 109 generates forces of the directions Z and −Y that are spaced at an angle of approximately 30°. By the forces, the print head unit 102 are pushed in the directions Z and −Y. As a result, the print head fixing part 114 of the print head unit 102 is reliably brought into contact with the print head contact 110 of the carriage 101, and it is positioned. The projections 113 of the print head unit 102 is pressed against the bottom of the projection supports 107, whereby the positioning in the direction Z. By the reaction forces of the contact pins 111, the projections 113 of the print head unit 102 are stably pressed against the projection supports 107 of the carriage 101 in the direction Y, thereby positioning it in the direction Y at this position. In this way, the print head unit 102 is precisely positioned in the direction Y and X. For the positioning of the print head unit 102 in the direction X, the projections 113 and the side walls of the carriage 101 are used.

In FIG. 28, there is illustrated a state that the print head unit 102 is assembled into the carriage 101. After the print head unit 102 is assembled, the ink tank 103 is attached to the assembly of the print head unit 102 and the carriage 101. In this instance, four ink tanks are attached, one for black ink and the remaining three for color inks. The ink tanks of the seventh embodiment of the present invention are used in this instance. If required, the ink tanks of any of the first to fifth embodiments may be used in lieu of the ink tanks of the seventh embodiment. Each ink tank 103 is provided with the coupling pieces 119. In attaching the ink tank 103, an operator holds the knob between his thumb and finger, and insets it into its location. Then, the coupling pieces 119 of the ink tank 103 are coupled with the print head contact 110, so that the ink tank 103 is pushed against the print head unit 102 in the direction Z. By the pushing force, the joint port of the ink tank 103 is pressed against the ink guides 116 of the print head unit 102, thereby forming a hermetically closed ink path.

The lower part of the front side of the ink tank 103 comes in contact with the front part of the carriage, whereby the ink tank 103 is positioned in the direction Y. The positioning of the ink tank 103 in the direction Y is also made by the back wall of the ink guides 116 of the print head unit 102 and a concave part located near the print head contact 110 of the carriage 101. The ink tank 103 is positioned in the direction X by the partition walls defining the ink guides 116 of the print head unit 102, and a concave part located near the print head contact 110 of the carriage 101. In this instance, pawl-like members are provided on the surface of the carriage 101, which faces the bottom surface of the ink tank 103. The ink tank 103 is pushed and fixed with the pawl-like member. A state that four ink tanks have been loaded into the print head unit 102 114 is shown in FIG. 29.

In FIGS. 27 to 30, the ink tanks of the seventh embodiment are used. If required, the ink cartridges as of the first to fifth embodiments may be used. The printers shown in FIGS. 18, 19, and 27 to 30 are each designed to contain four ink tanks. Three ink tanks of three colors except black or five or more number of ink tanks may be used. The ink supply device of the present invention may be applied for the printer of the monocolor type, as a matter of course. While the above-mentioned embodiment uses two print heads, the black print head 117 and the color print head 118, the print head may be provided for each color. In the above-mentioned embodiment, the ink supply device is applied to the printer of the type in which for print, the print medium is moved in the vertical scan direction. It is evident that the ink supply device of the present invention may be applied to another type of the printer, for example, a printer in which the print medium is fixed, and the print head is moved in the directions X and Y.

As seen from the foregoing description, the ink supply device of the present invention is capable of blocking the entering of air bubbles into the print head without increasing the fluid resistance of ink, thereby ensuring a good print quality, and of detecting the amount of left ink. The ink supply device of the type which is removably attached to the print head reduces air staying at the joint portion of the ink supply device and the print head, the amount of ink consumed in the maintenance work, and the amount of air moving to the print head.

The protruded portion is protruded from and forms the lowermost portion of the bottom of the capillary member at a location thereof adjoining to the through-hole connecting to the print head. When the capillary member is inserted into the main ink chamber, the protruded portion is deformed. The slanting bottom surface of the capillary member is more slanted than the slanting bottom surface of the main ink chamber. Therefore, when the bottom surface of the capillary member is entirely brought into contact with the bottom surface of the main ink chamber, a portion of the capillary member near the through-hole is more compressed than a portion thereof apart from the through-hole.

The density of the capillary member decreases from the bottom portion thereof near to the through-hole to the portion thereof apart from the through-hole. In other words, such a density distribution is caused in the capillary member. When ink is consumed by the print head, ink starts to move at the terminal of the capillary member where is low in density and weak in ink holding force, so that an efficient ink supply is ensured with little residual ink.

With deformation of the protruded portion forming the lowermost portion of the bottom of the capillary member, the lower part of the capillary member just above the through-hole is particularly high in density, thereby blocking air coming in through a minute gap between the walls of the main ink chamber and the capillary member. As a result, an efficient ink supply is ensured with little residual ink.

In the ink supply device of the type which is removably attached to the print head, the means for preventing the finger from closing the air hole is provided near the air hole. With provision of the means for preventing the closing of the air hole, no ink is leaked when the ink tank is attached to the print head. The means for preventing the closing of the air hole is so shaped as to allow the ink supply device to fall down. By so shaping, no dust is accumulated on the joint port. The meniscus is not broken down, thereby eliminating the leakage of ink.

What is claimed is:

1. An ink supply device for suppling ink to a print head, comprising:

a main ink chamber having an air hole and a through-hole for supplying ink;

a capillary member contained in said main ink chamber;

a meniscus forming member having a plurality of minute holes and disposed in said through-hole in contact with said capillary member;

a hermetically closed intermediate ink chamber, said intermediate ink chamber having a smaller capacity than that of said main ink chamber; and a passage communicating with said through-hole of said main ink chamber, said intermediate ink chamber, and said print head, said passage having a slanted upper wall ascending from a connection part of said passage and said through-hole toward said intermediate ink chamber, said slanted wall guiding air bubbles passing through said meniscus forming member to said intermediate ink chamber in such a manner as to allow smooth movement of the air bubbles along said slanted wall.

2. The ink supply device of claim 1, further comprising:

preventing means for preventing from closing said air hole, said means disposed near said air hole.

3. The ink supply device of claim 1, wherein a bottom surface of said main ink chamber is slanted ascending from said through-hole and a slanted bottom surface of said capillary member is more slanted than said slanted bottom surface of said main ink chamber, and wherein said capillary member is inserted into said main ink chamber such that said slanted bottom surface of said capillary member is entirely brought into contact with said slanted bottom surface of said main ink chamber.

4. The ink supply device of claim 1, wherein said ink supply device and said print head are united into a one-piece construction.

5. The ink supply device of claim 1, wherein said passage having a joint port for supplying ink to said print head;

said ink supply device, further comprising;

a second meniscus forming member having a plurality of minute holes disposed in said joint port, wherein said slanted wall guides air bubbles passing through said meniscus forming member to said intermediate ink chamber in such a manner as to allow smooth movement of the air bubbles along said slanted wall, and said ink supply device is connected at said joint port to said print head.

6. The ink supply device of claim 5, further comprising:

an ink absorbing member on the side of said joint port that is closer to said print head.

7. The ink supply device of claim 5, wherein a bubble point pressure of said second meniscus forming member is higher than that of said print head.

8. The ink supply device of claim 1, wherein at least a part of said intermediate ink chamber is transparent.

9. The ink supply device of claim 8, wherein said transparent part of said intermediate ink chamber is formed only in the part thereof for checking as to whether or not ink is present.

10. The ink supply device of claim 8, wherein said transparent part of said intermediate ink chamber includes means for providing a reference for judging whether or not ink is present.

11. The ink supply device of claim 1, wherein said connection part between said passage and said main ink chamber is located between said intermediate ink chamber and a fluid passage connecting to said print head.

12. The ink supply device of claim 1, wherein said meniscus forming member is provided with an ink supply portion, extended up to the bottom of said passage, for supplying ink from said passage to said meniscus forming member.

13. An ink supply device for supplying ink to a print head, comprising:

a main ink chamber including an air hole and a through-hole for supplying ink, a capillary member contained in said main ink chamber; and a meniscus forming member having a plurality of minute holes and disposed in said through-hole in contact with said capillary member, wherein a bottom surface of said main ink chamber is slanted ascending from said through-hole, a slanted bottom surface of said capillary member is more slanted than said slanted bottom surface of said main ink chamber, and wherein said capillary member is inserted into said main ink chamber such that said slanted bottom surface of said capillary member is entirely brought into contact with said slanted bottom surface of said main ink chamber.

14. The ink supply device of claim 13, further comprising;

preventing means for preventing from closing said air hole, said means disposed near said air hole.

15. An ink supply device for suppling ink to a print head, comprising:

a main ink chamber having an air hole and a through-hole for supplying ink;

a capillary member contained in said main ink chamber;

a meniscus forming member having a plurality of minute holes and disposed in said through-hole in contact with said capillary member;

a hermetically closed intermediate ink chamber; and wherein a bottom surface of said main ink chamber is slanted ascending from said through-hole, a slanted bottom surface of said capillary member is more slanted than said slanted bottom surface of said main ink chamber, and wherein said capillary member is inserted into said main ink chamber such that said slanted bottom surface of said capillary member is entirely brought into contact with said slanted bottom surface of said main ink chamber.

16. The ink supply device of claim 15, further comprising:

preventing means for preventing from closing said air hole, said means disposed near said air hole.

17. The ink supply device of claim 15, wherein a portion of said bottom surface of said capillary member where is to be located facing said through-hole, is protuberant, and said capillary member is inserted into said main ink chamber till said protruded portion is deformed.

18. The ink supply device of claim 15, further comprising:

a passage communicating with said through-hole of said main ink chamber, said intermediate ink chamber, and said print head, said passage having a slanted upper wall ascending from a connection part of said passage and said through-hole toward said intermediate ink chamber, wherein said slanted wall guides air bubbles passing through said meniscus forming member to said intermediate ink chamber in such a manner as to allow smooth movement of the air bubbles along said wall.

19. An ink supply device for supplying ink to a print head, comprising:

a main ink chamber having an air hole and a through-hole for supplying ink;

a capillary member contained in said main ink chamber;

a first meniscus forming member having a plurality of minute holes and disposed in said through-hole in contact with said capillary member.

20. The ink supply device of claim 19, further comprising:

a hermetically closed intermediate ink chamber;

a passage communicating with said through-hole of said main ink chamber and said intermediate ink chamber and having a joint port for supplying ink to said print head;

a second meniscus forming member having a plurality of minute holes and disposed in said joint port; and preventing means for preventing from closing said air hole, said means disposed near said air hole.

21. The ink supply device of claim 19, wherein said preventing means including a couple of projections disposed on both sides of said air hole.

22. The ink supply device of claim 21, wherein said projections are long members each being curved outward.

23. The ink supply device of claim 19, wherein said passage communicating with said through-hole of said main ink chamber, said intermediate ink chamber, and said print head, said passage having a slanted upper wall ascending from a connection part between said path and said through-hole toward said intermediate ink chamber, wherein said slanted wall guides air bubbles passing through said meniscus forming member to said intermediate ink chamber in such a manner as to allow smooth movement of the air bubbles along said slanted wall.

24. The ink supply device of claim 19, wherein a bottom surface of said main ink chamber is slanted ascending from said through-hole, a slanted bottom surface of said capillary member is more slanted than said slanted bottom surface of said main ink chamber, and wherein said capillary member is inserted into said main ink chamber such that said slanted bottom surface of said capillary member is entirely brought into contact with said slanted bottom surface of said main ink chamber.

25. A method of supplying ink from an ink supply device to a print head with which the ink supply device is removably coupled, said ink supply device including:

a main ink chamber having an air hole and a through-hole for supplying ink, a capillary member contained in said main ink chamber, a first meniscus forming member having a plurality of minute holes and disposed in aid through-hole in contact with said capillary member, a passage communicating with said main ink chamber and said intermediate ink chamber and having a joint port for supplying ink to said print head, a second meniscus forming member having a plurality of minute holes and disposed in the joint port, and a hermetically closed intermediate ink chamber communicating with the passage, said print head, including:

nozzles for forcibly spouting ink droplets, and an ink guide means that may be water-tightly coupled with said joint port of the ink supply device, the method, comprising: the steps of coupling said joint port of said ink supply device with said ink guide means of said print head in a state that said air hole of said main ink chamber is left open, causing air staying between said joint port and said ink guide means to flow into said passage through said second meniscus forming member by a pressure generated when said joint port is coupled with said ink guide means, and supplying ink from said ink supply device to said print head through said joint port, with increase of a negative pressure in said print head.

26. The ink supply method of claim 25, wherein coupling said ink supply device with said print head so that said intermediate ink chamber is disposed above said passage, causing air staying between said joint port and said ink guide means to flow into said path through said second meniscus forming member, by pressure generated when said joint port is coupled with said ink guide means, and moving the air to said intermediate ink chamber.

27. The ink supply method of claim 25, wherein a bubble point pressure of said second meniscus forming member is higher than that of said nozzles of said print head.

* * * * *

UNITED STATES PATENT AND TRADEMARK OFFICE

CERTIFICATE OF CORRECTION

PATENT NO. : 5,886,721

DATED : March 23, 1999

INVENTOR(S) : Katsuyuki FUJII et al.

It is certified that error appears in the above-identified patent and that said Letters Patent is hereby corrected as shown below:

Claim 1, Column 27, line 12, "suppling" should read --supplying--.

Claim 14, Column 28, line 40, "comprising;" should read --comprising:--.

Claim 15, Column 28, line 43, "suppling" should read --supplying--.

* Claim 25, Column 30, line 15, "aid" should read --said--.

Signed and Sealed this

Twenty-eighth Day of December, 1999

*Attest:*

Q. TODD DICKINSON

*Attesting Officer*

*Acting Commissioner of Patents and Trademarks*